US007169522B2

(12) United States Patent
Sugiura et al.

(10) Patent No.: US 7,169,522 B2
(45) Date of Patent: Jan. 30, 2007

(54) TONER FOR DEVELOPING A LATENT ELECTROSTATIC IMAGE, DEVELOPER USING THE SAME, FULL-COLOR TONER KIT USING THE SAME, IMAGE-FORMING APPARATUS USING THE SAME, IMAGE-FORMING PROCESS CARTRIDGE USING THE SAME AND IMAGE-FORMING PROCESS USING THE SAME

(75) Inventors: Hideki Sugiura, Shizuoka (JP); Satoshi Mochizuki, Shizuoka (JP); Yasuo Asahina, Shizuoka (JP); Kazuhiko Umemura, Shizuoka (JP); Minoru Masuda, Shizuoka (JP); Tomomi Tamura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 51 days.

(21) Appl. No.: 10/385,719

(22) Filed: Mar. 12, 2003

(65) Prior Publication Data

US 2003/0232266 A1 Dec. 18, 2003

(30) Foreign Application Priority Data

Mar. 12, 2002 (JP) ..... 2002-067243
Mar. 29, 2002 (JP) ..... 2002-096348

(51) Int. Cl.
*G03G 9/09* (2006.01)

(52) U.S. Cl. ..... 430/107.1; 430/109.1; 430/109.2; 430/110.3; 430/114.4; 430/45; 430/120

(58) Field of Classification Search ..... 430/107.1, 430/109.1, 109.2, 110.1, 110.3, 111.4, 45, 430/120, 126; 399/252, 119
See application file for complete search history.

(56) References Cited

U.S. PATENT DOCUMENTS

| | | | | |
|---|---|---|---|---|
| 2,297,691 | A * | 10/1942 | Carlson | 430/55 |
| 5,554,478 | A * | 9/1996 | Kuramoto et al. | 430/109.2 |
| 5,659,857 | A * | 8/1997 | Yamazaki et al. | 399/252 |
| 5,740,507 | A | 4/1998 | Ichikawa et al. | |
| 5,771,426 | A | 6/1998 | Oka et al. | 399/119 |
| 5,840,456 | A | 11/1998 | Tomita et al. | 430/109.1 |
| 5,975,446 | A | 11/1999 | Yaguchi et al. | 241/76 |
| 6,074,794 | A | 6/2000 | Fushimi et al. | 430/109.2 |
| 6,303,258 | B1 | 10/2001 | Katoh et al. | 430/110.1 |
| 6,356,729 | B1 | 3/2002 | Sasaki et al. | 399/258 |
| 6,363,229 | B1 | 3/2002 | Shiraishi et al. | 399/68 |
| 6,406,826 | B1 | 6/2002 | Suzuki et al. | 430/111.35 |
| 6,447,973 | B1 | 9/2002 | Asami et al. | 430/114 |
| 6,493,529 | B1 | 12/2002 | Umemura et al. | 399/168 |
| 6,500,595 | B1 | 12/2002 | Mochizuki et al. | 430/137.14 |
| 6,503,676 | B1 | 1/2003 | Yamashita et al. | 430/108.3 |
| 2003/0118366 | A1* | 6/2003 | Nukada et al. | 399/109 |

FOREIGN PATENT DOCUMENTS

| | | |
|---|---|---|
| JP | 49-46951 | 5/1974 |
| JP | 52-17023 | 2/1977 |
| JP | 52-086334 | 7/1977 |
| JP | 52-156632 | 12/1977 |
| JP | 57-130043 | 8/1982 |
| JP | 57-130044 | 8/1982 |
| JP | 60-263951 | 12/1985 |
| JP | 61-024025 | 2/1986 |
| JP | 61-219051 | 9/1986 |
| JP | 61-235852 | 10/1986 |
| JP | 62-280755 | 12/1987 |
| JP | 01-267560 | 10/1989 |
| JP | 01-304467 | 12/1989 |
| JP | 02-066561 | 3/1990 |
| JP | 03-294864 | 12/1991 |
| JP | 04-039671 | 2/1992 |
| JP | 04-204665 | 7/1992 |
| JP | 04-230770 | 8/1992 |
| JP | 04-335357 | 11/1992 |
| JP | 05-341617 | 12/1993 |
| JP | 07-003600 | 1/1995 |
| JP | 07-043930 | 2/1995 |
| JP | 07-271087 | 10/1995 |
| JP | 08-029598 | 2/1996 |
| JP | 08-202071 | 8/1996 |
| JP | 2568244 | 10/1996 |
| JP | 09-101632 | 4/1997 |

(Continued)

OTHER PUBLICATIONS

Diamond, A. S., ed., *Handbook of Imaging Materials*, Marcel Dekker, NY (1991), pp. 254-255.*

(Continued)

*Primary Examiner*—Janis L. Dote
(74) *Attorney, Agent, or Firm*—Oblon, Spivak, McClelland, Maier & Neustadt, P.C.

(57) ABSTRACT

The toner for developing a latent electrostatic image to form an image contains a binder resin and 2% by weight to 15% by weight of a coloring agent. The coverage of the toner with the coloring agent on a surface of the toner is 1.5% by atom to 15% by atom. The toner prevents scatterings and toner deposition on the background of images and provides high quality images even after printing several tens of sheets at high temperature and in high humidity.

20 Claims, 7 Drawing Sheets

FOREIGN PATENT DOCUMENTS

| | | | |
|---|---|---|---|
| JP | 11-189646 | | 7/1999 |
| JP | 11-212299 | | 8/1999 |
| JP | 2992924 | | 10/1999 |
| JP | 3047310 | | 3/2000 |
| JP | 2001-083733 | * | 3/2001 |
| JP | 2001-228653 | | 8/2001 |

OTHER PUBLICATIONS

Japanese Patent Office machine-assisted translation of JP 2001-083733 (pub. Mar. 2001).*
Diamond, A.S., ed., *Handbook of Imaging Materials*, Marcel Dekker, Inc., NY (1991), pp. 168-169.*
USPTO Trademark Electronic Search System (Tess) printout of US Registered trademark HENSCHEL MIXER, serial No. 75599986, Feb. 9, 2004.*
USPTO English-language translation of JP 2001-083733 (Pub. Mar. 2001).*
U.S. Appl. No. 10/176,578, filed Jun. 24, 2002, Niimi, et al.
U.S. Appl. No. 10/020,925, filed Dec. 19, 2001, Mochizuki et al.
U.S. Appl. No. 10/059,240, filed Jan. 31, 2002, Sugiura et al.
U.S. Appl. No. 10/086,415, filed Mar. 4, 2002, Sugiura et al.
U.S. Appl. No. 10/107,157, filed Mar. 28, 2002, Masuda et al.
U.S. Appl. No. 10/059,239, filed Jan. 31, 2002, Mochizuki et al.
U.S. Appl. No. 10/158,069, filed May 31, 2002, Matsuda et al.
U.S. Appl. No. 10/151,103, filed May 21, 2002, Kondo et al.
U.S. Appl. No. 10/077,752, filed Feb. 20, 2002, Iwamoto et al.
U.S. Appl. No. 10/098,556, filed Mar. 18, 2002, Emoto et al.
U.S. Appl. No. 09/985,738, filed Nov. 6, 2001, Sugiura et al.
U.S. Appl. No. 09/845,449, filed Apr. 30, 2001, Sugiura et al.
U.S. Appl. No. 10/086,683, filed Mar. 4, 2002, Terao et al.
U.S. Appl. No. 10/101,756, filed Mar. 21, 2002, Sasaki et al.
U.S. Appl. No. 10/077,813, filed Feb. 20, 2002, Matsuda et al.
U.S. Appl. No. 10/079,878, filed Feb. 22, 2002, Katoh et al.
U.S. Appl. No. 09/988,142, filed Nov. 19, 2001, Kotsugai et al.
U.S. Appl. No. 09/993,606, filed Nov. 27, 2001, Kotsugai et al.
U.S. Appl. No. 09/996,585, filed Nov. 30, 2001, Higuchi et al.
U.S. Appl. No. 09/982,877, filed Oct. 22, 2001, Matsuda et al.
U.S. Appl. No. 09/964,622, filed Sep. 28, 2001, Nanya et al.
U.S. Appl. No. 09/965,826, filed Oct. 1, 2001, Higuchi et al.
U.S. Appl. No. 09/384,797, filed Aug. 27, 1999.
U.S. Appl. No. 09/891,652, filed Jun. 26, 2001.
U.S. Appl. No. 10/729,960, filed Dec. 9, 2003, Tomita et al.
U.S. Appl. No. 10/740,665, filed Dec. 22, 2003, Nagashima et al.
U.S. Appl. No. 10/742,835, filed Dec. 23, 2003, Tsuda et al.
U.S. Appl. No. 10/752,589, filed Jan. 8, 2004, Masuda et al.
U.S. Appl. No. 10/759,029, filed Jan. 20, 2004, Sugiura et al.
U.S. Appl. No. 10/759,197, filed Jan. 20, 2004, Emoto et al.
U.S. Appl. No. 10/766,874, filed Jan. 30, 2004, Yamashita et al.
U.S. Appl. No. 10/772,435, filed Feb. 6, 2004, Shiraishi et al.
U.S. Appl. No. 10/802,866, filed Mar. 18, 2004, Saito et al.
U.S. Appl. No. 10/802,887, filed Mar. 18, 2004, Tanaka et al.
U.S. Appl. No. 10/784,204, filed Feb. 24, 2004, Umemura et al.
U.S. Appl. No. 10/804,084, filed Mar. 19, 2004, Takada et al.
U.S. Appl. No. 10/804,082, filed Mar. 19, 2004, Tanaka et al.
U.S. Appl. No. 10/844,442, filed May 13, 2004, Yamashita et al.
U.S. Appl. No. 10/876,718, filed Jun. 28, 2004, Sugiyama et al.
U.S. Appl. No. 10/875,402, filed Jun. 25, 2004, Sugiura et al.
U.S. Appl. No. 10/959,663, filed Oct. 7, 2004, Sugiura et al.
U.S. Appl. No. 10/960,084, filed Oct. 8, 2004, Yamada et al.
U.S. Appl. No. 11/184,976, filed Jul. 20, 2005, Sugiura et al.
U.S. Appl. No. 11/223,998, filed Sep. 13, 2005, Shu et al.
U.S. Appl. No. 11/227,178, filed Sep. 16, 2005, Hasegawa et al.
U.S. Appl. No. 11/336,909, filed Jan. 23, 2006, Masuda.

* cited by examiner

TONER FOR DEVELOPING A LATENT ELECTROSTATIC IMAGE, DEVELOPER USING THE SAME, FULL-COLOR TONER KIT USING THE SAME, IMAGE-FORMING APPARATUS USING THE SAME, IMAGE-FORMING PROCESS CARTRIDGE USING THE SAME AND IMAGE-FORMING PROCESS USING THE SAME

BACKGROUND OF THE INVENTION

1. Field of the Invention

The present invention relates to a toner for developing a latent electrostatic image, a full-color toner kit for developing a latent electrostatic image, a developer containing the toner for developing a latent electrostatic image, an image-forming process using the developer, a developer-container which contains the developer, an image-forming apparatus including the developer-container, and an image-forming process cartridge.

2. Description of the Related Art

An image-forming process according to electrostatic developing steps and electrostatic printing steps typically includes a developing step for uniformly charging a photoconductive insulative layer, irradiating the insulative layer with radiation, scattering charges on exposed portions to thereby form a latent electrostatic image, and supplying a toner with fine particles to the latent electrostatic image to thereby visualize the image; a transferring step of transferring the visualized image onto a transfer material such as paper; and an image-fixing step of fixing the image by heating and/or pressurizing, generally using a heat roller. Such developers for developing a latent electrostatic image formed on a surface of a latent electrostatic image support include double-component developers containing a carrier and a toner, and single-component developers (magnetic toners and non-magnetic toners) which do not require a carrier. An ordinary full-color image forming apparatus has functions in which toner images with different colors formed on a photoconductor are sequentially transferred onto an intermediate transfer and are temporarily held thereon. Thereafter, the images are transferred onto a transfer material at once.

Toners for developing an electrostatic image and for printing an electrostatic image mainly comprise a binder resin and a coloring agent and may further comprise a charge control agent, an offset-preventing agent, and, if necessary, may comprise other additives. The toners are required to have various capabilities and properties in each of the steps. For example, to allow a toner to be disposed onto a latent electrostatic image in the developing step, the toners and the binder resin for the toner are required to maintain an appropriate charge amount suitable for use in copying machines or printers, regardless of temperature, humidity, and other conditions. In the fixing step using a heat roller, the toners are required to have satisfactory anti-offset performance so as not to adhere to a heat roller heated to about 100° C. to 230° C. and high image-fixing properties to paper. In addition, the toners are required to have satisfactory blocking resistance, so as not to induce blocking while being stored in a copier.

Various attempts have been made in the techniques for developing a latent electrostatic image so as to furthermore improve image quality. Of those techniques, downsized and spherical toners are believed to be very effective to improve image quality. However, such downsized and spherical toners have deteriorated charging stability and cause scattering of toner particles, where toner particles scatter from a developing unit to inner walls of the apparatus. The scattering of toner particles significantly occurs at high temperature and in high humidity.

Under these circumstances, demands have been made on image formation procedures at a higher speed in color copiers and color printers. To form images at a higher speed, a "tandem system" is effective (as disclosed in Japanese Patent Application Laid-Open (JP-A) No. 05-341617). In the "tandem system," images formed by an image-forming unit are sequentially transferred and superimposed onto a single transfer paper (transfer material) transported by a transfer belt to thereby form a full-color composite image on the transfer paper (transfer material). Such a color image forming apparatus according to the tandem system accepts a wide variety of transfer papers (transfer materials), can form full-color images with high quality at a high speed. In particular, the apparatus can form full-color images at a higher speed than conventional color image forming apparatus which employs the other systems.

Another attempt has been made to form images at a high speed, at the same time as to attain high image quality using a spherical toner. If an apparatus according to this system is operated at a higher speed, the toner is required to pass through the developing unit in a shorter time. A toner for use herein must therefore be stirred at a higher speed at a higher torque in a charging procedure and developing procedure, so as to achieve a similar developing capability to the conventional developing capability. As a result, the toner may frequently contain weakly charged particles and inversely charged particles. Accordingly, the toner is likely to cause scattering of toner particles from the developing unit.

To improve flowability and charging properties of toners, "external additives" such as metal oxide particles and other inorganic powder are added to the toner particles. To modify hydrophobicity, charging properties, and other properties of the surface on the inorganic powders, the surface of the inorganic powders is treated with a specific silane coupling agent, a titanate coupling agent, silicone oil, or organic acid or the like, or is covered with a specific resin. Examples of the inorganic powder include powder of silicon dioxide (silica), of titanium dioxide (titania), aluminum oxide, zinc oxide, magnesium oxide, cerium oxide, iron oxide, copper oxide, tin oxide, and the like.

Of these, hydrophobic silica fine particles or titanium oxide fine particles are often used. Such hydrophobic silica in fine particles or titanium oxide in fine particles are prepared by allowing fine particles of the silica or the titanium oxide to react with an organosilicon compound such as dimethyldichlorosilane, hexamethyldisilazane, silicone oil or the like to substitute a silanol group on the surface of fine particles with an organic group.

Of these hydrophobing agents, silicone oil has sufficient hydrophobicity and enables a toner containing the silicone oil to exhibit satisfactory transfer properties, due to its low surface energy. Japanese Patent Application Publication (JP-B) No. 07-3600 and Japanese Patent No. 2568244 states the degree of hydrophobicity of silica treated with silicone oil. JP-A No. 07-271087 and JP-A No. 08-29598 state the amount of silicone oil or the carbon content in additives. The silicone oil content and the degree of hydrophobicity are, as disclosed in the JP-A Nos. 07-271087 and 08-29598, sufficient to turn treated inorganic fine particles to be hydrophobic and to ensure stable charging properties of the developer at high humidity.

However, no positive attempt has been made to reduce adhesion of a developer to members to be in contact with the developer utilizing such low surface energy of the silicone oil.

Such members include a contact charging device, a developer-bearing member (sleeve), a doctor blade, a carrier, a latent electrostatic image support (photoconductor), and an intermediate transfer. In particular, toner deposition on the background of images, and dropout after transfer (portions where the developer is not transferred) in edges or centers of characters, lines, and dots in images occur due to strong deposition of the developer to the photoconductor. In addition, when the transfer member has large depressions and protrusions, the image cannot satisfactorily be transferred to the depressions, thus inviting white patches. Simple control of the amount of the silicone oil or the degree of hydrophobicity are insufficient to solve these problems. JP-A No. 11-212299 discloses inorganic fine particles containing a specific amount of silicone oil as a liquid component. However, the use of the silicone oil in the specified amount does not satisfy the above requirements.

The toner for developing a latent electrostatic image must be charged uniformly and stably. If not, the toner causes toner deposition on the background of images or non-uniform image density to thereby deteriorate image quality. A developing unit is downsized, as an image-forming apparatus has been downsized. Rapid charge rise for a toner thereby increases in its importance to obtain high image quality in such a downsized developing unit. To satisfy these requirements, various proposals have been made. For example, to improve charging properties of a toner for developing a latent electrostatic image by adding additives, JP-A No. 03-294864 discloses a non-magnetic single-component developer comprising an inorganic powder treated with silicone oil; JP-A No. 04-204665 discloses a magnetic single-component developer in which an additive covers 3% to 30% of a toner; and JP-A No. 04-335357 discloses an electrostatic developer comprising a toner and an external additive, in which toner has fine particles with a BET specific surface area of 5 $m^2/g$ to 100 $m^2/g$ fixed on its surface, and which external additive is particles having a specific surface area 1.2 times or more of that of the fine particles fixed on the toner. JP-A No. 07-43930 discloses a developer using a non-magnetic single-component toner including hydrophobic silica fine particles and specific hydrophobic titanium oxide; and JP-A No. 08-202071 discloses a developer containing a toner additive comprising organic-inorganic composite particles having an organic polymer skeleton and a polysiloxane skeleton.

However, even these techniques cannot sufficiently attain uniform charging and good rapid charge rise for a toner. These techniques are not sufficient in stability in surroundings of toner charge, particularly in stability of toner charge with respect to high humidity. Most of these techniques employ an additive having improved hydrophobicity as a result of a surface treatment of oxide particles. The use of such an additive, however, shows deterioration of the toner due to a change in a composition of the additive over a time for operating, although the toner exhibits a desired stable charging at early stages. The composite particles prepared by a liquid phase process as disclosed in JP-A No. 08-202071 may not have sufficient hydrophobicity and may exhibit varying hydrophobicity with time, due to a mediating substance remained inside the particles.

Binder resins for use in toners are required to have transparency, insulating properties, water resistance, fluidity as a powder, mechanical strength, glossiness, thermoplasticity, grindability, and the like. Under these requirements, polystyrenes, styrene-acrylic copolymers, polyester resins, and epoxy resins are generally used as the binder resins. Among them, styrenic resins are widely used for their satisfactory grindability, water resistance, and fluidity. However, when a photocopy obtained by using a toner containing a styrenic resin is stored in a paper holder made of a vinyl chloride resin sheet, an image bearing surface of the copy is left in intimate contact with the sheet. A plasticizer contained in the vinyl chloride resin sheet then migrates into and plasticizes the fixed toner image to thereby allow the toner image to adhere to the sheet. When the photocopy is removed from the sheet, part or whole of the toner image is peeled off from the photocopy and causes toner adhesion on the sheet. This problem also occurs in a toner containing a polyester resin.

To avoid migration of the toner to such a vinyl chloride resin sheet, JP-A No. 60-263951 and JP-A No. 61-24025 propose blending of an epoxy resin with a styrenic resin or polyester resin, since such an epoxy resin is not plasticized by a plasticizer for vinyl chloride resins.

However, when the blended resin is used for color toners, the resulting toner cannot satisfy all of the requirements in anti-offset performance, resistance to curling of fixed images, glossiness, colorability, transparency, and color reproducibility. For example, if a color toner image has insufficient glossiness, it is seen as a weak image. Conventional epoxy resins and acetylated modified epoxy resins, proposed in JP-A No. 61-235852, do not satisfy all of the requirements.

A possible solution to these problems is using an epoxy resin alone. However, such epoxy resins are reactive to amines. The epoxy resins are generally used as curable resins having satisfactory mechanical strength and chemical resistance. These properties are derived from their crosslinked structure formed as a result of a reaction between an epoxy group and a curing agent. Such curing agents are roughly classified into amine curing agents and organic acid anhydride curing agents. Naturally, an epoxy resin for use in a toner for developing a latent electrostatic image is used as a thermosetting resin. However, some dyes, pigments, and charge control agents to be kneaded with the resin to manufacture a toner are amine agents and invite a crosslinking reaction during kneading. The resulting crosslinked article cannot be used as a toner. In addition, the chemical activity of the epoxy group may potentially induce biochemical toxicity such as skin irritation, which must be avoided.

In addition, the epoxy group has hydrophilicity and the toner markedly absorbs water at high temperature and in high humidity. The epoxy group thus causes a decrease in charge, toner deposition on the background of images, and insufficient cleaning. The epoxy resin also shows insufficient charging stability.

Regular toners each comprise a binder resin, a coloring agent, a charge control agent, and other additives to be added according to necessity. Such coloring agents include various dyes and pigments, and some of them have charge control properties and thereby play a role both as a coloring agent and a charge control agent. Such toners having the above composition are generally prepared using a variety of resins as the binder resin. These toners have a problem that the dye or pigment, the charge control agent, and other additives are insufficiently dispersed. The dye or pigment and the charge control agent are generally kneaded with the binder resin in a heat roll mill and must be uniformly dispersed in the binder resin. However, it is difficult to disperse these components uniformly. If the dye or pigment as the coloring agent is not sufficiently dispersed, the toner may exhibit insufficient color development and decreased colorability (degree of coloring). If the charge control agent is not sufficiently dispersed, charges distribute non-uniformly, thus inviting various defects or failures such as charging failure, toner deposition on the background of images, scattering of toner particles, insufficient image density, fuzzing, and insufficient cleaning. JP-A No. 61-219051 discloses a toner using an ester-modified epoxy resin modified with ε-caprolactone as a binder resin. The epoxy resin used herein is modified in a high magnitude of 15% by weight to 90% by weight, and the resulting toner has an excessively low softening point and excessively high glossiness, although it has improved resistance to vinyl chloride resins and fluidity.

JP-A No. 52-86334 discloses an epoxy resin having positive charges prepared by allowing a terminal epoxy group of a prepared epoxy resin to react with an aliphatic primary or secondary amine. However, the epoxy group may crosslink with amine as described above, and the resulting resin may not be used as a toner. JP-A No. 52-156632 discloses that one or both of terminal epoxy groups of an epoxy resin are allowed to react with alcohol, phenol, a Grignard reagent, an organic acid sodium acetylide, or an alkyl chloride. However, a residual epoxy group, if any, may invite problems such as reactivity with amines, toxicity, and hydrophilicity. In addition, some of the aforementioned reaction products are hydrophilic, affect charging properties, or affect grindability in the preparation of toners, and thereby are not always effective to satisfy all of the requirements.

JP-A No. 01-267560 discloses a modified epoxy resin prepared by allowing both terminal epoxy groups of an epoxy resin to react with a monovalent compound having an active hydrogen and esterifying the reaction product with a monocarboxylic acid, an ester derivative or a lactone derivative thereof. The resulting epoxy resin does not exhibit sufficiently improved resistance to curling in image-fixing, although problems in the reactivity, toxicity and hydrophilicity of the epoxy resin are solved.

Solvents such as xylene or the like are often used in preparation of epoxy resins or polyol resins as disclosed in JP-A No. 11-189646. These solvents and unreacted residual monomers such as bisphenol A remain in a significantly large amount in the produced resins and consequently in toners using the resins.

Certain toners using a dye as a coloring agent are disclosed, for example, in JP-A No. 57-130043 and JP-A No. 57-130044. However, these toners using a dye as a coloring agent have insufficient light fastness and undergo discoloring or fading when they are left under direct radiation, although the toners can yield sharp color images with high transparency and good color development.

Toners using a pigment as a coloring agent are disclosed, for example, in JP-A No. 49-46951 and JP-A No. 52-17023. However, the color toners using a pigment as a coloring agent have insufficient colorability (color development) and insufficient transparency due to poor dispersibility of the pigment into a binder resin, although having high light fastness.

To improve dispersibility of a pigment to a binder resin, the following techniques have been proposed.

(1) JP-A No. 62-280755 discloses a technique in which a polyester resin (resin A) is used as a binder resin, a pigment is covered with another polyester resin (resin B) having a molecular weight higher than the resin A in advance, and the covered pigment is dispersed into the resin A to thereby manufacture a color toner.

(2) JP-A No. 02-66561 discloses a color toner comprising a binder resin and a treated pigment dispersed in the binder resin, in which the treated pigment is obtained by melting and kneading a resin and a pigment resin, the pigment resin has a weight-average molecular weight lower than the binder resin, and the binder resin has a weight-average molecular weight of 100000 or more.

(3) JP-A No. 09-101632 discloses a technique for manufacturing a color toner, in which a mixture of a binder resin and a pigment is kneaded with an organic solvent at a temperature lower than a melting temperature of the binder resin in a first kneading step, and the resulting kneaded product is heated, melted and further kneaded with another portion of the binder resin and a charge control agent in a second kneading step.

(4) JP-A No. 04-39671 discloses a toner comprising a binder resin having a weight-average molecular weight of 40000 or less and a coloring agent containing a flushing pigment prepared by using the binder resin.

(5) JP-A No. 04-230770 discloses a technique for preparing a toner, which comprises mixing a solvent with a first binder resin soluble in the solvent and a coloring agent insoluble in the solvent; dispersing particles of the coloring agent into the binder resin at a temperature of 50° C. to 100° C. under a pressure (under a load) and under the application of shear force; removing the solvent to thereby manufacture a colored binder resin composition having dispersed particles of the coloring agent; and heating, melting, and further kneading the binder resin composition with another binder resin and a charge control agent in a second kneading step to thereby manufacture a toner.

However, even according to the techniques (1) and (2), the pigment is not sufficiently dispersed and the resulting toners have insufficient colorability and transparency.

Each of the techniques (3), (4), and (5) exhibits improved dispersibility of the pigment, but employs a solvent. Because of the solvent, the resulting products or toners still contain the solvent in a very slight amount, even though it is supposed to be removed. The inventors of the present invention have found that such a residual solvent in a toner decreases the charge of the toner under special conditions such as high temperature and causes scattering of toner particles in a developing unit. The scattering of toner particles adversely affects the maintainability of the apparatus, and the scattered toner particles adhere to a non-printed portion.

Japanese Patent No. 2992924 and Japanese Patent No. 3047310 disclose toners containing a coloring agent having a specific particle diameter. These toners, however, have insufficiently improved color transparency, color development, and light fastness, although having sufficient colorability. In particular, they cannot avoid scattering of toner particles at high temperature and in high humidity and toner deposition on the background of images at low temperature and in low humidity. JP-A No. 2001-228653 discloses a toner containing a coloring agent having a specific particle diameter distribution, but this toner has insufficient light fastness, since particles having smaller particle diameters are not taken into account.

Such toners are generally produced by a process comprising the steps of mixing all materials at once, heating, melting, and dispersing the resulting mixture to yield a homogenous composition, cooling, pulverizing, and classifying the composition to thereby manufacture a toner having a volume-average particle diameter of 6 μm to 10 μm, as disclosed in JP-A No. 01-304467.

Color toners for use in electrostatic development in the formation of color images generally comprises a color dye or pigment dispersed in a binder resin and require more strict performances than those for use in the formation of black images. Specifically, the color toners must have satisfactory color development (colorability), color reproducibility in composite colors, color developing properties, color gradation, sharpness (definition or visibility), optical transparency when used in over head projectors (OFPs), and high light fastness in any environment, in addition to mechanical and electrical stability to external factors such as impact and humidity. A technique to use a dye for a coloring agent can be found in JP-A No 57-130043 and JP-A No. 57-130044. The technique shows excellent transparency, and enables producing a clear and sharp color image with excellent corlability. The technique, however, shows a poor light fastness, and exhibits shade change and/or discoloring, when left in direct sunshine.

Toners after manufactured are exposed to severe conditions such as high temperature and high humidity or low temperature and low humidity while being stored and transported. The toners must therefore have high storage stability with no or little deterioration in charging properties, fluidity, transfer properties, and image-fixing properties without aggregation of toner particles even after storage under those conditions above. However, no effective solution to these requirements has been found.

SUMMARY OF THE INVENTION

Accordingly, an object of the present invention is to stably provide a toner, a developer, an image-forming process, and an image-forming apparatus, in which the toner exhibits highly stable and satisfactory charging properties, includes fewer weakly charged particles and inversely charged particles and does not invite scattering of toner particles even after it is stored at high temperature and in high humidity for a long time and is subjected to printing several tens of thousands of sheets at high temperature and in high humidity.

Another object of the present invention is to stably provide a toner, a developer, an image-forming process, an image-forming process cartridge and an image-forming apparatus, in which the toner exhibits satisfactory charging stability, includes fewer weakly charged particles and inversely charged particles and does not invite toner deposition on the background of images, even after it is subjected to printing several tens of thousands of sheets not only at normal temperature and humidity but also at low temperature and low humidity.

Yet another object of the present invention is to stably provide a toner, a developer, an image-forming process, and an image-forming apparatus, in which the resulting images have sufficient coloring properties (colorability), light fastness, transparency, color development, sharpness, color reproducibility, chromaticness (color saturation), and glossiness even after the toner is subjected to printing several tens of thousands of sheets.

Still another object of the present invention is to stably provide, an image-forming apparatus, image-forming process cartridge and an image-forming process having high durability and good maintainability as an image forming system.

Another object of the present invention is to stably provide a toner for developing a latent electrostatic image, a developer, an image-forming apparatus, image-forming process cartridge and an image-forming process, in which the toner has necessary and sufficient rapid charge rise for a toner and can keep necessary and sufficient charges both at high temperature and in high humidity and at low temperature and in low humidity.

Yet another object of the present invention is to stably provide an image-forming apparatus, image-forming process cartridge and an image-forming process, which do not show decrease in image density in continuous image output at a printing speed in a range from low to a high speed and have well-balanced image-fixing properties and anti-offset performance.

Still another object of the present invention is to stably provide a toner, a developer, an image-forming process, and an image-forming apparatus, in which the toner exhibits highly stable and satisfactory charging properties, includes fewer weakly charged particles and inversely charged particles and does not invite scattering of toner particles, even if it contains spherical particles having a small particle diameter and a high degree of circularity.

A further object of the present invention is to stably provide an image-forming apparatus, image-forming process cartridge and an image-forming process which do not invite transferring of toner images to a vinyl chloride resin sheet, even when a fixed image bearing surface is brought into intimate contact with a vinyl chloride resin sheet.

Another object of the present invention is to stably provide an image-forming apparatus and an image-forming process which can form fixed images substantially without curling.

After intensive investigations, the present inventors have found that the above objects can be achieved by using a toner including at least a binder resin and a coloring agent, in which a coverage with the coloring agent is 1.5% by atom to 15% by atom on a surface of the toner, and the toner contains 2% by weight to 15% by weight of the coloring agent, relative to the total weight of the toner. The toner preferably has 0.05% by atom to 1.3% by atom of nitrogen atoms on its surface, relative to the total atoms on the surface. The toner exhibits highly stable and satisfactory charging properties, includes fewer weakly charged particles and inversely charged particles and does not invite scattering of toner particles even after it is stored at high temperature and in high humidity for a long time and is subjected to printing several tens of thousands of sheets at high temperature and in high humidity. The toner also exhibits satisfactory charging stability, includes fewer weakly charged particles and inversely charged particles. The toner does not invite toner deposition on the background of images even after it is subjected to printing several tens of thousands of sheets not only under normal temperature and normal humidity conditions but also at high temperature and in high humidity and at low temperature and in low humidity. The toner enables forming high-quality images having satisfactory colorability, light fastness, transparency, color development, sharpness, color reproducibility, color saturation (chromaticness), and glossiness, even after it is subjected to printing several tens of sheets of images.

The mechanism is now under study, and some analytical data suggest the followings. In X-ray photoelectron spectroscopy (XPS), X-rays are applied to a sample, and energy of produced photoelectrons is analyzed. This technique can qualitatively and/or quantitatively analyze elements on an extreme surface of the sample having a depth of several nanometers. The surface of a toner plays a very important role to produce and maintain charges. The surface conditions must be essentially controlled to control charging properties, image-fixing properties, color properties, and other properties of the toner. Recent studies have revealed that a coloring agent is not preferable material from the viewpoint of charging properties of the toner, although it is necessary for coloring the toner to form color images. Specifically, if the coloring agent is present on the surface of the toner in an amount exceeding a certain level, it adversely affects the charging properties of the toner, covers a resin and a charge control agent for allowing the toner to be charged and thereby reduces charge sites of the toner. The present inventors have found that a toner satisfying the above requirements and having satisfactory charging properties can be obtained by controlling the coverage with the coloring agent on the surface of the toner at 1.5% by atom to 15% by atom, and preferably 2.0% by atom to 13% by atom, and also by containing 2% by weight to 15% by weight, and preferably 4% by weight to 11% by weight of the coloring agent in the toner.

If the coverage is less than 1.5% by atom, the amount of the coloring agent on the surface of the toner is excessively small to thereby decrease the colorability. In addition, to reduce the amount of the coloring agent to such an excessively small amount, the coloring agent is excessively finely dispersed, and the crystallinity of the coloring agent decreases to thereby decrease light fastness. The present inventors have also found that such an excessively dispersed toner composition undergoes cleavage of molecular chains of the binder resin to thereby adversely affect image-fixing properties, thus inviting hot offset. If the excessively dispersed toner composition is pulverized to yield a pulverized toner, the toner is not sufficiently pulverized to thereby decrease its productivity and increase its cost. In contrast, if the coverage is more than 15% by atom, aggregates of the coloring agent on the surface of the toner become separated from the toner during the manufacture of the toner, thus causing spent coloring agent on the surface of a carrier or on the surface of a development sleeve. Charge sites of the toner thereby decrease to adversely affect charging properties and stability in print quality. In addition, the coloring agent is present in an excessively large amount on a surface of the toner, and the binder resin and the charge control agent serving to control the charging properties of the toner cover less of the surface of the toner to thereby adversely affect the total charging properties of the toner. The resulting toner includes larger amounts of weakly charged particles and inversely charged particles to invite scattering of toner particles and/or toner deposition on the background of images particularly at high temperature and in high humidity, at low temperature and in low humidity, and other conditions which invite variation in charge level.

The present inventors have also found that nitrogen atoms are electrically positively charged and adversely affect the charging properties of a negatively charged toner. Such nitrogen atoms are often contained in coloring agents, rather than in some resins. Control of the distribution of the nitrogen atoms in the toner is important to control the charging properties. Specifically, if the nitrogen atoms are present on the surface of the toner in an amount exceeding a specific level, they adversely affect the charging properties of the toner, cover the other resin skeleton and the charge control agent contributing negative charge of the toner and thereby reduce charge sites of the toner. If the toner is a positively charged toner, the excessive amount of nitrogen atoms invites excessively high charges, thus causing a decreased image density. The present inventors thereby have found that a toner further satisfactorily satisfying the requirements and having further sufficient charging properties can be obtained by controlling the amount of nitrogen atoms on the surface of the toner at 0.05% by atom to 1.3% by atom, relative to the total atoms on the surface of the toner.

According to the present invention, the amount of nitrogen atoms on the surface of the toner is preferably based on a measurement by X-ray photoelectron spectroscopy (XPS). In XPS, X-rays are applied to a sample, and energy of produced photoelectrons is analyzed. This technique can qualitatively and/or quantitatively analyze elements on an extreme surface of the sample having a depth of several nanometers.

If the amount of nitrogen atoms on the surface of the toner is less than 0.05% by atom, the amount of the coloring agent on the surface of the toner may be excessively small to thereby decrease the colorability. In addition, the coloring agent may be excessively finely dispersed to reduce the amount of the nitrogen atoms, and the crystallinity of the coloring agent may decrease to thereby decrease light fastness. The present inventors have also found that such an excessively dispersed toner composition undergoes section of molecular chains of the binder resin to thereby adversely affect image-fixing properties, thus inviting hot offset. If the excessively dispersed toner composition is pulverized so as to manufacture a pulverized toner, the toner may not be sufficiently pulverized to thereby decrease its productivity and increase its cost. In contrast, if the amount of nitrogen atoms on the surface of the toner is more than 1.3% by atom, aggregates of nitrogen-containing components or the like in the coloring agent and the resin may become separated from the surface of the toner during manufacturing the toner, thus causing spent coloring agent on the surface of a carrier or on the surface of development sleeves. Charge sites of the toner may thereby decrease to adversely affect charging properties and stability in quality of printing. In addition, the coloring agent or nitrogen-containing components may be exposed in an excessively large amount on the surface of the toner, and the binder resin and the charge control agent serving to control the charging properties of the toner may cover less of the surface of the toner to thereby adversely affect the total charging properties of the toner. The resulting toner may include larger amounts of weakly charged particles and inversely charged particles, which invites scattering of toner particles and/or toner deposition on the background of images particularly under an environment where variation of charge level is likely to occur, such as high temperature and high humidity, low temperature and low humidity.

In addition, by containing 2% by weight to 15% by weight of the coloring agent in the toner, the resulting toner can have sufficient colorability and can prevent scattering of toner particles and toner deposition on the background of images. If the amount of the coloring agent is less than 2% by weight, the colorability per weight of the toner deteriorates, and the toner layer is required to have a larger thickness to ensure the same colorability as an image. In this case, the amount of the toner in developing and transferring steps increases and the color reproducibility decreases with an increasing thickness of the toner layer, thus inviting scattering of toner particles and toner deposition on the background of images. In contrast, if the amount of the coloring agent is more than 15% by weight, the toner may have deteriorated charging properties, although it has high colorability. Specifically, an excess amount of the coloring agent covers the surface of the toner, and relative proportions of the binder resin and the charge control agent on the surface of the toner decrease to thereby decrease charging ability of the toner, thus inviting scattering of toner particles and toner deposition on the background of images.

Control of the amount of the coloring agent on the surface of the toner, namely, control of dispersion of the coloring agent into the resin is a key in the present invention. The present inventors have found that when the binder resin of the toner includes at least a polyol resin, the coloring agent can be satisfactorily dispersed and the resulting toner has sufficient charging properties under various conditions, tensile break strength, stability in surroundings, and stable image-fixing properties. The inventors have also found that when the binder resin of the toner includes at least a polyol resin having an epoxy resin moiety and a polyoxyalkylene moiety in its main chain, the toner has further stable dispersibility of the coloring agent, stability in surroundings, and further stable image-fixing properties. The resulting toner can prevent adhesion of toner images even when an image bearing surface is brought into intimate contact with a vinyl chloride resin sheet. When the toner is used as a color toner, the color toner can have satisfactory color reproducibility, stable glossiness and can prevent curling of paper on which fixed images are photocopied.

If a conventional toner for developing a latent electrostatic image includes particles of a small particle diameter in terms of volume-average particle diameter of 1 μm to 6 μm, the resulting toner has high image quality but has decreased charging properties due to its small particle diameter and small contact area, includes larger amounts of weakly charged particles and inversely charged particles to thereby have a smaller margin relative to scattering of toner particles and toner deposition on the background of images. However, the present inventors have found that, by controlling the amount of nitrogen atoms on the surface of the toner, the toner even having such a small particle diameter can maintain sufficient colorability and can prevent scattering of toner particles and toner deposition on the background of images.

If a toner has a higher circularity and is more spherical having a circularity in SF-1 of 100 to 140 and a circularity in SF-2 of 100 to 130, the toner exhibits high image quality but has a smaller margin against scattering of toner particles and toner deposition on the background of images. This is because such a spherical toner has a decreased frictional resistance and is hardly held by a carrier (development sleeve). The present inventors have found that even such a spherical toner can maintain sufficient colorability and prevent scattering of toner particles and toner deposition on the background of images, by controlling the amount of nitrogen atoms on the surface of the toner.

When the toner is used in combination with a carrier including magnetic particles for an image developer in which a double-component developer is employed, the resulting image developer can maintain stable charging properties, exhibits well-balanced adhesion to the carrier, less stress variation and a sufficient bulk density as a developer and shows satisfactorily rapid charge rise for a toner and stable charging stability under various conditions, even though using the toner containing a highly colored and highly dispersed coloring agent. The image developer can satisfactorily control its toner concentration using, for example, a bulk density sensor.

In a tandem color image-forming apparatus, a latent electrostatic image divided into multiple colors on a latent electrostatic image support are developed using a plurality of multicolor developers for electrostatic development to thereby form a toner image; a transfer device is brought into contact with the surface of the latent electrostatic image support to thereby transfer and sequentially dispose the toner images onto a single transfer material to thereby yield a color composite image on the latent electrostatic image support. If the apparatus is operated at a high printing speed of 20 sheets or more per minute, preferably 25 sheets or more per minute, and more preferably 30 sheets or more per minute, when using A4-sized sheets, the toner must be transported in a developing step in a shorter time. Therefore, a toner for use herein must be stirred at a higher speed at a higher torque during charging and developing steps to achieve developing capability equivalent to conventional equivalents. As a result, the toner may frequently comprise weakly charged toner particles and inversely charged toner particles to thereby invite scattering of toner particles at the developing step. The present inventors have found that, by controlling the amount of nitrogen atoms on the surface of the toner, the toner can maintain sufficient colorability and can prevent scattering of toner particles and toner deposition on the background of images. The resulting image-forming apparatus using the toner can exhibit high image quality and good maintainability and can attain less transfer failure during the transferring operation and less image defects regardless of the transfer material such as OHP transparencies, thick paper, and coated paper.

The present invention has been accomplished based on the findings above.

Specifically, the present invention provides, in a first aspect, a toner for developing a latent electrostatic image which comprises a binder resin and a coloring agent. In the toner of the present invention, a coverage with the coloring agent on a surface of the toner is 1.5% by atom to 15% by atom, and the toner contains 2% by weight to 15% by weight of the coloring agent.

The toner of the present invention may contain the binder resin which contains a polyol resin.

The toner of the present invention may comprise the binder resin that contains a polyol resin having an epoxy resin moiety and a polyoxyalkylene moiety in a main chain thereof.

The toner of the present invention may have a volume-average particle diameter of 1 μm to 6 μm.

The toner of the present invention may have a circularity of 100 to 140 in SF-1, and a circularity of 100 to 130 in SF-2.

The toner of the present invention may have one of black, magenta, yellow and cyan coloring agents.

The toner of the present invention may have 0.05% by atom to 1.3% by atom of a nitrogen atom on a surface of thereof, relative to a total number of atoms on the surface.

The toner of the present invention may comprise the binder resin that contains a polyol resin.

The toner of the present invention may have a volume-average particle diameter of 1 μm to 6 μm.

The present invention also provides, in a second aspect, a developer that contains the toner of the present invention.

The developer of the present invention may further contain carriers formed of magnetic particles.

The developer of the present invention may be a single-component developer.

The present invention also provides, in a third aspect, a full-color toner kit for developing a latent electrostatic image which comprises the toner of the present invention. The toner may be, in the third aspect, one of a magenta toner, a yellow toner, and a cyan toner.

The present invention further provides, in a fourth aspect, a developer container which comprises the developer of the present invention in which the toner of the present invention is contained.

The present invention still further provides, in a fifth aspect, an image-forming apparatus which comprises a latent electrostatic image support, a charger configured to charge the latent electrostatic image support, a light-irradiator configured to irradiate a light to the latent electrostatic image support imagewisely so as to form a latent electrostatic image, an image developer configured to have the developer container of the present invention, to supply the developer of the present invention to the latent electrostatic image, and to visualize the latent electrostatic image, so as to form a toner image and a transfer configured to transfer the toner image onto a transfer material.

The present invention yet still further provides, in a sixth aspect, an image-forming process cartridge which comprise the developer of the present invention, an image developer configured to have the developer container of the present invention, and to supply the developer of the present invention to a latent electrostatic image, so as to visualize the latent electrostatic image and form a toner image, and one of a latent electrostatic image support and a charger configured to charge a surface of the latent electrostatic image uniformly and a cleaner configured to clean the surface of the latent electrostatic image support. The image-forming process cartridge of the present invention may be formed in one-piece construction, and may be attachable to and detachable from an image-forming apparatus.

The present invention still further provides, in a seventh aspect, an image-forming process which comprises the step of charging a latent electrostatic image support, the step of irradiating a light to the latent electrostatic image support, the step of supplying the developer of the present invention so as to visualize a latent electrostatic image and to form a toner image, and the step of transferring the toner image onto a transfer material.

With the image-forming process of the present invention, a color image is formed by a tandem method at a speed of 20 sheets per minute or faster, when an A4-sized sheet is used.

DESCRIPTION OF THE PREFERRED EMBODIMENTS

Figure 1:
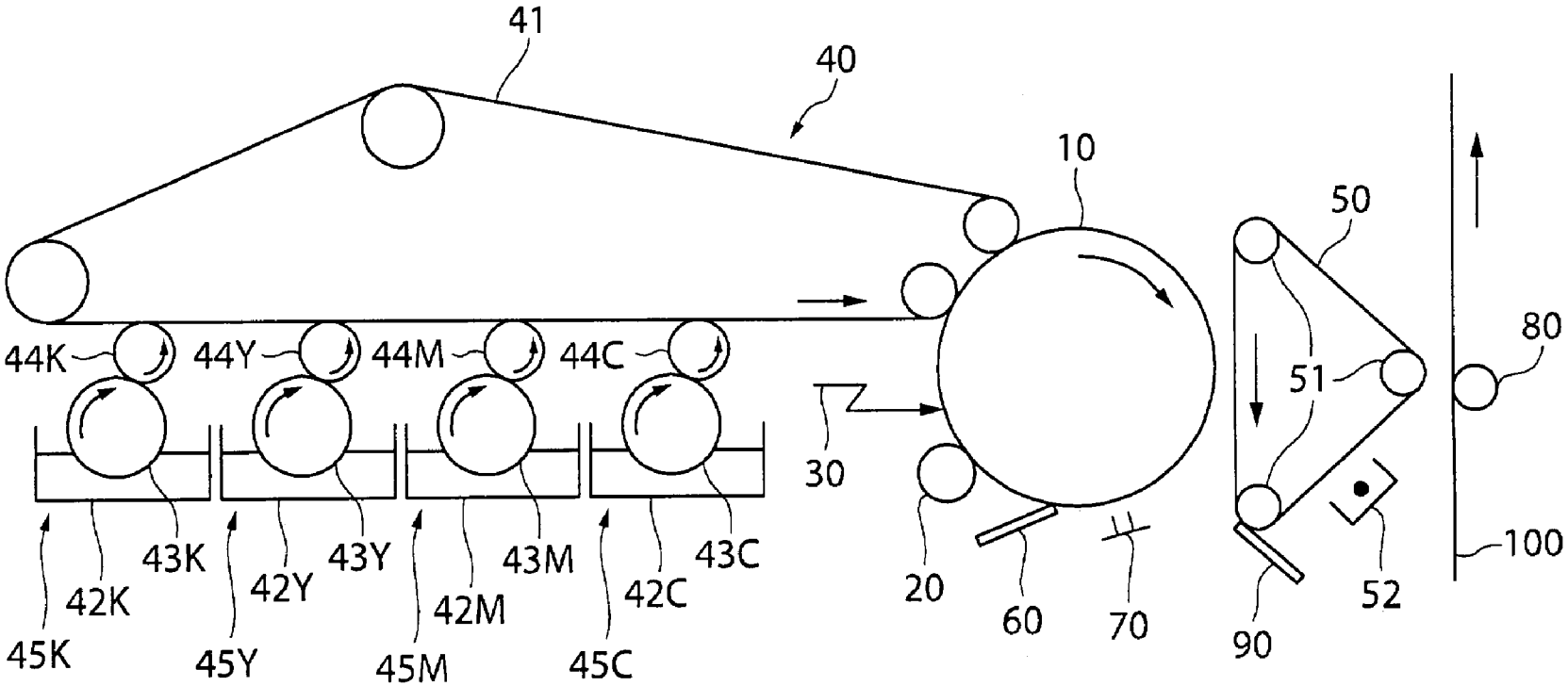
FIG. 1 is a schematic diagram showing an example of the image-forming apparatus (copying machine) of the present invention.

The present invention will be described in detail hereinafter.

Any known preparation processes and materials for toners and developers for electrostatic development, and entire systems regarding electrostatic development processes can be employed in the present invention, as long as they satisfy the requirements. The term, "developer," herein refers to any kinds of agent to develop a latent electrostatic image.

(Coverage with Coloring Agent)

The coverage with the coloring agent is 1.5% by atom to 15% by atom, and preferably 2.0% by atom to 13% by atom on the surface of the toner in the present invention. The coverage with the coloring agent on a surface of the toner herein refers to an abundance ratio in atomic ratio of atoms of the coloring agent to all of the atoms on the surface of the toner. The coverage with the coloring agent as used herein is a coverage "C," which is obtained by to following Equation (3), using an amount of an element (% by atom) specific to the coloring agent. The amount of an element can be measured by various methods. The measurement based on the XPS is preferable in the present invention. The element specific to the coloring agent is a nitrogen element.

$$C=E\times T/N \qquad \text{Equation (3)}$$

wherein "C" is the coverage (% by atom) of the coloring agent; "E" is the amount (% by atom) of an element specific to the coloring agent; "T" is the number of total atoms in the coloring agent; and "N" is the number of atoms of the specific element in the coloring agent.

As the element specific to the coloring agent, nitrogen is preferred. In the measurement, the type of a measuring system and the conditions are not specifically limited as long as they can produce equivalent results, and preferred systems. The conditions and the measuring system are as follows:

Measuring system: X-ray photoelectron spectrometer, Model 1600S available from PHI (Physical Electronics, Inc.)

X-ray source: Mg Kα (400 W)

Analysis area: 0.8×2.0 mm

Pretreatment: A sample is filled into an aluminum dish, and the aluminum dish is fixed to a sample holder using a carbon sheet.

Measurement of surface atomic concentration: A relative sensitivity factor available from PHI (Physical Electronics, Inc.) is used.

(Amount of Nitrogen Atoms on the Surface of the Toner)

The amount of nitrogen atoms on the surface of the toner is preferably measured by, for example, XPS. In the measurement, a measuring process, the type of a measuring system and conditions are not specifically limited as long as they can produce equivalent results. The preferred system and conditions are as follows.

Measuring system: X-ray photoelectron spectrometer, Model 1600S available from PHI (Physical Electronics, Inc.)

X-ray source: Mg Ka (400 W)

Analysis area: 0.8×2.0 mm

Pretreatment: A sample is filled into an aluminum dish, and the aluminum dish is fixed to a sample holder using a carbon sheet.

Measurement of surface atom concentration:

A relative sensitivity factor available from PHI (Physical Electronics, Inc.) is used.

(Master Batch Coloring Agents)

A coloring agent for use in the present invention may be a master batch coloring agent prepared by mixing and kneading the coloring agent with a resin to thereby improve miscibility (compatibility) of the resin and the coloring agent. Such coloring agents for use herein can be any substances that can color resins such as pigments and dyes. The weight ratio of the resin to the coloring agent is preferably 20:80 to 80:20, more preferably 30:70 to 70:30, and still more preferably 40:60 to 60:40. The resin for use in the master batch is not necessarily the same resin as the binder resin of the toner. Preferred resins are polyol resins and polyester resins having satisfactory affinity to the binder resin of the toner. Similar resins as in the binder resin mentioned later can be used herein. The dispersibility of the master batch coloring agent can be further improved by using a dry powder pigment as the coloring agent and using water to yield wettability with the resin. A pigment inherently includes very small primary particles of 0.001 μm to 0.1 μm, but when it is used as a dry powder as a raw material, it includes large aggregates with several micrometers. The aggregate is preferably ideally dispersed and crushed into primary particles, since such small primary particles of 0.001 μm to 0.1 μm cannot significantly be converted into smaller particles according to an ordinary kneading procedure by repeated application of mechanical shearing force. In other words, insufficient dispersion of the pigment means that the aggregate is not crushed into the primary particles. To disassemble the aggregate, a surrounding resin must enter voids inside the aggregate and efficiently wet the surface of entire primary particles. This means the surrounding resin must enter the voids inside the aggregate to disperse the pigment effectively. A binder resin for use in a regular toner has a high melt viscosity and requires large energy to enter the aggregate. However, the resulting pigment is not disassembled into primary particles even in this state.

An organic pigment used as a coloring agent is generally hydrophobic, but water can enter inside the aggregate by applying a certain level of force, since the organic pigment is subjected to washing with water and drying processes while manufactured. When the pigment containing water inside its aggregate is kneaded with a resin in an open kneader at 100° C. or higher, water inside the aggregate instantaneously reaches its boiling point and expands, thus causing force to disassemble the aggregate from inside thereof. The force from inside the aggregate can much more efficiently disassemble the aggregate than external force. The resin in this state is heated to a temperature higher than its softening point, has thereby a decreased viscosity and can efficiently wet the aggregate. In addition, the resin replaces the water heated at a temperature around its boiling point inside the aggregate due to an effect similar to "flushing." The resulting master batch coloring agent contains the pigment substantially dispersed in the form of primary particles. During its vaporization, the water deprives the kneaded product of the heat of vaporization, and the kneaded product is held at a relatively low temperature of 100° C. or lower at relatively high viscosity. Thus, shearing force is effectively applied to the aggregate of the pigment. Open kneaders for use in manufacturing the master batch coloring agent include regular two-roll kneaders, three-roll kneaders, as well as open-type Banbury mixers, and continuous two-roll kneaders available from Mitsui Mining Co., Ltd. To further satisfactorily disperse the coloring agent in the resin, it is effective to roughly pulverize a kneaded master batch coloring agent using, for example, a pulverizer and to repeat the kneading procedure.

(Coloring Agents)

Any conventional or known dyes and pigments can be used as a coloring agent of the toner according to the present invention. Among them, organic pigments being highly lipophilic are preferred. Examples of the pigments and dyes include, but are not limited to, carbon black, nigrosine dyes, black iron oxide, Naphthol Yellow S, Hansa Yellow (10G, 5G, and G), cadmium yellow, yellow iron oxide, yellow ochre, chrome yellow, Titan Yellow, Oil Yellow, Hansa Yellow (GR, A, RN, and R), Permanent Yellow (NCG), Pyrazolone Orange, Benzidine Orange G, Permanent Red 4R, calcium salt of Watchung Red, Brilliant Carmine 38, Fast Violet B, Methyl Violet Lake, Indanthrene Blue BC, Vulcan Fast Yellow (5G, R), Tartrazine Lake, Quinoline Yellow Lake, Anthragen Yellow BGL, isoindolinone yellow, red oxide, red lead oxide, red lead, cadmium red, cadmium mercury red, antimony red, Permanent Red 4R, Para Red, Fire Red, parachloroorthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Naphthol Carmine, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian emerald green, Pigment Green B, Naphthol Green B, Green Gold, Acid Green Lake, Malachite Green Lake, Phthalocyanine Green, Anthraquinone Green, titanium oxide, zinc white, lithopone, and mixtures thereof, and the like.

Preferable examples of the coloring agents include pigments having high light fastness and high dispersibility in resins, such as polycondensed azo pigments, insoluble azo pigments, quinacridone pigments, carmine pigments, naphthol-carmine pigments, isoindolinone pigments, perylene pigments, anthraquinone pigments, and copper-phthalocyanine pigments.

Specific examples of such pigments are as follows.

Magenta coloring pigments include, for example, C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C.I. Pigment Violet 19; and C.I. Vat Red 1, 2, 10, 13, 15, 23, 29, and 35.

Cyan coloring pigments include, for example, C.I. Pigment Blue 2, 3, 15, 15:1, 15:2, 15:3, 15:4, 15:6, 16, 17, and 60; C.I. Vat Blue 6; C.I. Acid Blue 45, copper phthalocyanine pigments having one to five phthalimidomethyl groups on a phthalocyanine skeleton, Green 7, and Green 36.

Yellow coloring pigments include, for example, C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, and 180; C.I. Vat Yellow 1, 3, and 20, and Orange 36.

The content of the coloring agent is 2% by weight to 15% by weight, and preferably 3% by weight to 10% by weight relative to the total weight of the toner.

The toner may further comprise dispersion improvers to improve the dispersibility of the coloring agent in the resin.

(External Additives)

Any known external additives can be used in the present invention. Examples of the external additives include, but are not limited to, silica fine particles, hydrophobicized silica, fatty acid metal salts such as zinc stearate, aluminum stearate, or the like; metal oxides such as titania, alumina, tin oxide, and antimony oxide, fluoropolymers, or the like.

Among them, fine particles of hydrophobicized silica, titania, titanium oxide, and aluminum are preferred as external additives. Examples of the silica fine particles are commercially available under the trade names of HDK H 2000, HDK H 2000/4, HDK H 2050EP, HVK21, and HDK H 1303 from Hoechst AG or Clariant Japan K.K.; and R972, R974, RX200, RY200, R202, R805, and R812 from Nippon Aerosil Co., Ltd. Titania fine particles are commercially available under the trade names of P-25 from Nippon Aerosil Co., Ltd.; STT-30 and STT-65C-S from Titan Kogyo Kabushiki Kaisha; TAF-140 from FUJI TITANIUM INDUSTRY CO., LTD.; and MT-150W, MT-500B, MT-600B, and MT-150A from TAYCA Corporation. Hydrophobicized titanium oxide fine particles are commercially available under the trade names of T-805 from Nippon Aerosil Co., Ltd.; STT-30A, and STT-65S-S from Titan Kogyo Kabushiki Kaisha; TAF-500T, and TAF-1500T from FUJI TITANIUM INDUSTRY CO., LTD.; MT-100S, and MT-100T from TAYCA Corporation; and IT-S from Ishihara Sangyo Kaisha, Ltd.

Such hydrophobicized oxide fine particles, silica fine particles, titania fine particles, and alumina fine particles can be obtained by treating hydrophilic material fine particles with a silane coupling agent. Such silane coupling agents include, for example, methyltrimethoxysilane, methyltriethoxysilane, octyltrimethoxysilane, and the like. In addition, silicone oil-treated oxide fine particles and inorganic fine particles are also preferred. Such treated fine particles are prepared by treating material fine particles with silicon oil while heating, where necessary.

Examples of the silicone oils include, but are not limited to, dimethyl silicone oil, methyl phenyl silicone oil, chlorophenyl silicone oil, methyl hydrogen silicone oil, alkyl-modified silicone oils, fluorine-modified silicone oils, polyether-modified silicone oils, alcohol-modified silicone oils, amino-modified silicone oils, epoxy-modified silicone oils, epoxy-polyether-modified silicone oils, phenol-modified silicone oils, carboxyl-modified silicone oils, mercapto-modified silicone oils, acrylic or methacrylic-modified silicone oils, α-methylstyrene-modified silicone oils, and the like.

Examples of the inorganic fine particles include fine particles of silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride. Among them, silica and titanium dioxide fine particles are preferred.

The amount of the external additive is preferably 0.1% by weight to 5% by weight, and more preferably 0.3% by weight to 3% by weight, relative to the total weight of the toner. The inorganic fine particles should preferably have an average particle diameter of primary particles of 100 nm or less, and more preferably 3 nm or more and 70 nm or less. If the average particle diameter is less than this range, the inorganic fine particles are embedded in the toner to thereby fail to exhibit their functions effectively. If it exceeds the range, the particles may heterogeneously damage the surface of the photoconductor.

Each of the inorganic fine particles and hydrophobicized inorganic fine particles can be used in combination as the external additive. The external additive for use herein preferably comprises two or more types of hydrophobicized inorganic fine particles having an average particle diameter of primary particles of 1 nm to 100 nm and more preferably 5 nm to 70 nm. The external additive more preferably comprises two or more types of hydrophobicized inorganic fine particles having an average particle diameter of primary particles of 20 nm or less and one or more types of inorganic fine particles having an average particle diameter of primary particles of 30 nm or more. These fine particles preferably have a specific surface area of 20 $m^2/g$ to 500 $m^2/g$ as measured according to the Brunauer-Emmett-Teller (BET) method.

(Coupling Agents)

Examples of coupling agents (surface treatment agents) for the external additives including oxide fine particles include dialkyldihalogenosilanes, trialkylhalogenosilanes, alkyltrihalogenosilanes, hexaalkyldisilazanes, and the like; silylating agents; silane coupling agents having a fluoroalkyl group; organotitanate coupling agents; aluminum coupling agents; silicone oils; silicone varnish, and the like. Among them, organosilicon compound coupling agents and hydrophobicizing agents are preferred.

(Resin Fine Particles)

Resin fine particles can also be added as the external additive. Examples of the resin fine particles include, but are not limited to, fine particles of polystyrenes, copolymers of a methacrylic ester or an acrylic ester prepared by soap-free emulsion polymerization, suspension polymerization, or dispersion polymerization; and fine particles of silicone, benzoguanamine, nylons, and other polycondensation or thermosetting polymers. By using such resin fine particles in combination with the other external additive, the resulting developer can have further improved charging properties, include less inversely charged toner particles and reduce the toner deposition on the background of images.

The amount of the resin fine particles is, for example, 0.01% by weight to 5% by weight and preferably 0.1% by weight to 2% by weight, relative to the total weight of the toner.

(Circularity)

The circularities in terms of shape factors SF-1 and SF-2 for use in the present invention are measured in the following manner. A sample toner is subjected to scanning electron microscopic (SEM) observation using a scanning electron microscope FE-SEM (S-4200) available from Hitachi, Ltd. to obtain SEM images. Three hundreds of SEM images are randomly selected, and image information thereof is analyzed using an image analyzer (available from NIRECO Corporation, under the trade name of Luzex AP). The formation coefficiencies, SF-1 and SF-2, are measured by calculation according to the following Equations (1) and (2) based on the analyses. The shape factors SF-1 and SF-2 are preferably measured using Luzex AP, but measuring and analyzing systems for use herein are not limited to FE-SEM S-4200 and Luzex AP, as long as they can produce similar results.

$$SF\text{-}1=(L^2/A)\times(\pi/4)\times 100 \quad \text{Equation (1)}$$

$$SF\text{-}2=(P^2/A)\times(1/4\pi)\times 100 \quad \text{Equation (2)}$$

In the equations, "L" is the absolute maximum length of the toner; "A" is the projected area of the toner; and "P" is the maximum perimeter of the toner.

If a particle is exactly spherical, the particle has both SF-1 and SF-2 of 100. More than 100 of circularities in SF-1 and SF-2 means that the particle becomes amorphous. The shape factor SF-1 expresses the shape (oval, spherical, or the like) of the entire toner particle, and the shape factor SF-2 expresses the magnitude of depressions and protrusions on the surface of the toner particle.

(Softening Point and Flow Beginning Temperature)

The softening point and flow beginning temperature of the toner of the present invention can be measured using a softening point measuring system (available from Mettler Toledo GmbH under the trade name of FP90) at a heating rate of 1° C./min.

(Glass Transition Temperature, Tg)

The glass transition temperature, Tg, of the toner of the present invention can be measured using the following differential scanning calorimeter under the following conditions.

| | |
|---|---|
| Differential scanning calorimeter: | DSC-60A available from Shimadzu Corporation |
| Thermal analysis work station: | TA-60WS available from Shimadzu Corporation |
| Conditions: | |
| Temperature range: | 25° C. to 150° C. |
| Heating rate: | 10° C./min |
| Amount of sample: | 5 mg |

(Molecular Weight)

The number-average molecular weight (Mn), weight-average molecular weight (Mw) and peak molecular weight (Mp) of the toner can be measured by gel permeation-chromatography (GPC) in the following manner.

A total of 80 mg of a sample is dissolved in 10 ml of tetrahydrofuran (THF) to form a sample solution, and the sample solution is filtrated through a 5 μm-filter. A total of 100 μl of the sample solution is then injected into a column, and the retention time of the sample is measured under the following conditions. Separately, the retention time of polystyrene having a known average molecular weight as a reference material is obtained to thereby yield a calibration curve. The number-average molecular weight of the sample in terms of polystyrene is obtained based on the calibration curve.

Columns: Guard column, GLR 400M, GLR 400M, and GLR 400 (all available from Hitachi, Ltd.)

Column temperature: 40° C.

Mobile phase (flow rate): THF (1 ml/min)

Peak detection: UV (254 nm)

Penetration and Thermal Stability (High-temperature Storage Stability)

A total of 10 g of a sample toner is weighed, is placed in a 20 cc-glass container and is left stand in a thermostat set at 50° C. for 5 hours. Thereafter, the penetration of the sample is measured using a penetrometer.

(Binder Resins)

Binder resins for use in the toner of the present invention include, but are not limited to, styrene such as polystyrene, poly-p-chlorostyrene, polyvinyl toluene, or the like, and substituted styrenes; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic ester copolymer, or the like; poly(methyl methacrylate), poly(butyl methacrylate), poly(vinyl chloride), poly(vinyl acetate), polyethylene, polypropylene, polyester, epoxy resin, polyol resin, polyurethane, polyamide, poly (vinyl butyral), polyacrylic acid resin, rosin, modified rosin, terpene resin, aliphatic or alicyclic hydrocarbon resin, aromatic petroleum resin, chlorinated paraffin, paraffin wax, and the like. Each of the resin can be used either alone or in combination. Among them, polyol resin and polyester resin are preferred.

When the binder resin includes polyol resin having an inactive terminal, the resulting toner has satisfactory stability in surroundings and reduced toxicity.

(Examples Of Polyol Resins)

Polyol resins for use in the present invention include various types of polyol resins. Among them, polyol resins (epoxy resins) prepared by a reaction between a bisphenol such as bisphenol A or bisphenol F with epichlorohydrin are preferred. More preferably, the epoxy resin comprises two or more bisphenol A type epoxy resins having different number-average molecular weights to attain stable image-fixing properties and glossiness. A lower molecular weight fraction of the epoxy resin preferably has a number-average molecular weight of 360 to 2000, and a higher molecular weight fraction thereof preferably has a number-average molecular weight of 3000 to 10000. More preferably, the epoxy resin comprises 20% by weight to 50% by weight of the lower molecular weight fraction and 5% by weight to 40% by weight of the higher molecular weight fraction. If the epoxy resin comprises an excessively large amount of the lower molecular weight fraction or comprises a lower molecular weight fraction having an excessively low number-average molecular weight of less than 360, the resulting toner may have excessive glossiness or deteriorated storage stability. If the epoxy resin comprises an excessively large amount of the higher molecular weight fraction or comprises a higher molecular weight fraction having an excessively high number-average molecular weight more than 10000, the resulting toner may have insufficient glossiness or deteriorated image-fixing properties.

Preferred polyol resins for use in the present invention are polyol resins prepared by a reaction among (1) the epoxy resin, (2) an alkylene oxide adduct of dihydric phenol or glycidyl ether thereof, (3) a compound intramolecularly having one active hydrogen atom that can react with an epoxy group, and (4) a compound intramolecularly having two or more active hydrogen atoms that can react with an epoxy group. The epoxy resin (1) preferably comprises two or more types of bisphenol A epoxy resins having different number-average molecular weights. The resulting polyol resin has satisfactory glossiness and transparency of images and exhibits high anti-offset performance in image-fixing with a roller.

Examples of the alkylene oxide adduct of dihydric phenol (2) include reaction products of ethylene oxide, propylene oxide, butylene oxide or mixtures thereof with a bisphenol such as bisphenol A, bisphenol F, or the like. The resulting adducts may be glycidylated with epichlorohydrin or β-methylepichlorohydrin. Among them, diglycidyl ethers of alkylene oxide adducts of bisphenol A expressed by following Formula (1) are preferred:

Formula (1)

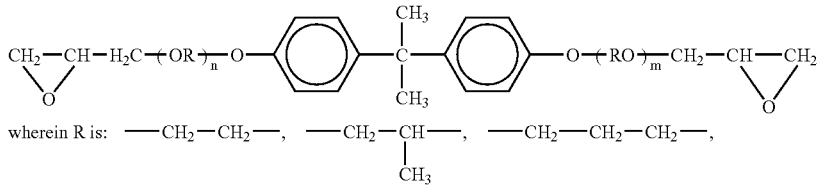

"n" and "m" are each the number of a repeated unit, are each 1 or more, and "n+m" is 2 to 8.

The polyol resin preferably comprises 10% by weight to 40% by weight of the alkylene oxide adduct of dihydric phenol or glycidyl ether thereof. If the content of the alkylene oxide adduct of dihydric phenol or glycidyl ether thereof is excessively small, the resulting toner may invite increased curling. If "n+m" is 7 or more or the amount of the alkylene oxide adduct of dihydric phenol or glycidyl ether thereof is excessively large, the resulting toner may invite excessive glossiness or deteriorated storage stability.

Examples of the compound (3) intramolecularly having one active hydrogen atom capable of reacting with an epoxy group for use in the present invention are monohydric phenols, secondary amines, and carboxylic acids. Such monohydric phenols include, but are not limited to, phenol, cresol, isopropylphenol, aminophenol, nonylphenol, dodecylphenol, xylenol, p-cumylphenol and the like. Examples of the secondary amines include, but are not limited to, diethylamine, dipropylamine, dibutylamine, N-methyl (ethyl)piperazine, piperidine, and the like. Examples of the carboxylic acids include, but are not limited to, propionic acid, caproic acid, and the like.

Examples of the compound (4) intramolecularly having two or more active hydrogens for use in the present invention include dihydric phenols, polyhydric phenols, polycarboxylic acids, and the like. Examples of the dihydric phenols include, for example, bisphenols such as bisphenol A, bisphenol F, or the like. Examples of the polyhydric phenols include, for example, orthocresol novolacs, phenol novolacs, tris(4-hydroxyphenyl)methane, and 1-[α-methyl-α-(4-hydroxyphenyl)ethyl]benzene. Examples of the polycarboxylic acids include malonic acid, succinic acid, glutaric acid, adipic acid, maleic acid, fumaric acid, phthalic acid, terephthalic acid, trimellitic acid, and trimellitic anhydride.

The binder resin preferably has a weight per epoxy equivalent of 20000 or more. By this configuration, the binder resin can have controlled thermal properties and includes reduced amount of low molecular weight materials such as epichlorohydrin. Thus, the resulting toner has satisfactory safety and resinous properties.

The polyol resin having an epoxy resin moiety and an alkylene oxide moiety in a main chain there of can be obtained from various combinations of materials. For example, the polyol resin can be obtained by allowing an epoxy resin having glycidyl groups at both ends and an alkylene oxide adduct of dihydric phenol having glycidyl groups at both ends to react with dihalide, isocyanate, diamine, dithiol, polyhydric phenol, or dicarboxylic acid. Among them, the epoxy resin and the adduct are preferably allowed to react with dihydric phenol for a more stable reaction. It is also preferable to use a polyhydric phenol and/or a polycarboxylic acid in combination with the dihydric phenol within ranges not inviting gelation. The amount of the polyhydric phenol and the polycarboxylic acid is preferably 15% by weight or less and more preferably 10% by weight or less, relative to the total amount of the materials. Examples of the polyhydric phenol for use herein include tris(4-hydroxyphenyl)methane, and 1-[α-methyl-α-(4-hydroxyphenyl)ethyl]benzene. Examples of the polycarboxylic acid include malonic acid, succinic acid, glutaric acid, adipic acid, terephthalic acid, trimellitic acid, and trimellitic anhydride.

By containing a polyol resin or a polyol resin having an epoxy resin moiety and a polyoxyalkylene moiety in a main chain thereof in the binder resin, the resulting toner is sufficiently resistant to compressive strength, has tensile break strength, stability in surroundings, and stable image-fixing properties. The toner can also prevent transfer of a toner image to a sheet made of a vinyl chloride resin when a copied fixed image bearing surface is brought into intimate contact with the sheet. When the toner is used as a color toner, the toner can exhibit satisfactory color reproducibility, stable glossiness and can prevent curling of copied fixed images. The polyol resin in the binder resin further preferably comprises a polyol resin moiety and a polyester resin moiety. The resulting toner with the moieties has further improved compressive strength and well-balanced stretching properties and adhesion and exhibits further stable transfer properties, developing properties and image-fixing properties.

(Examples of Polyester Resins)

Polyester resins are also preferably used as the binder resin. Such polyester resins can be any polyester resins but are preferably polyester resins prepared by allowing the following components (1'), (2') and (3') to react with one another:

(1') at least one selected from dicarboxylic acid, lower alkyl ester thereof and acid anhydrides thereof;

(2') a diol component expressed by following Formula (2):

Formula (2)

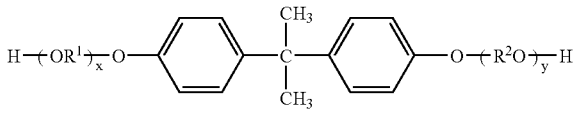

wherein $R^1$ and $R^2$ are identical or different and are each an alkylene group containing 2 to 4 carbon atoms; "x" and "y" are each the number of a repeated unit and are each 1 or more, and "x+y" is 2 to 16; and (3') at least one selected from trivalent or higher polycarboxylic acids, lower alkyl esters thereof and acid anhydrides thereof, and trihydric or higher polyhydric alcohols.

Examples of the component (1'), i.e., dicarboxylic acids, lower alkyl esters thereof and acid anhydrides thereof, include terephthalic acid, isophthalic acid, sebacic acid, isodecylsuccinic acid, maleic acid, and fumaric acid; monomethyl, monoethyl, dimethyl, and diethyl esters of these carboxylic acids; phthalic anhydride, and maleic anhydride. Among them, terephthalic acid, isophthalic acid, and dimethyl esters thereof are preferred for higher blocking resistance and lower cost. These dicarboxylic acids, lower alkyl esters thereof and acid anhydrides thereof largely affect the image-fixing properties and blocking resistance of the toner. Although depending on the degree of condensation, the use of an aromatic carboxylic acid such as terephthalic acid or isophthalic acid in a large amount decreases the image-fixing properties, while it increases the blocking resistance. In contrast, the use of sebacic acid, isodecylsuccinic acid, maleic acid, or fumaric acid in a large amount decreases the blocking resistance, while it increases the image-fixing properties. These dicarboxylic acids and derivatives thereof should be appropriately selected and used alone or in combination depending on the composition of the other monomers, proportions thereof, and degree of condensation.

Examples of the diol component (2') expressed by Formula (2) include polyoxypropylene-(n)-polyoxyethylene-(n')-2,2-bis(4-hydroxyphenyl)propane, polyoxypropylene-(n)-2,2-bis(4-hydroxyphenyl)propane, polyoxyethylene-(n)-2,2-bis(4-hydroxyphenyl)propane, and the like.

Among them, the preferred are polyoxypropylene-(n)-2,2-bis(4-hydroxyphenyl)propane where "n" satisfies a relation of: $2.1 \leqq n \leqq 2.5$, and polyoxyethylene-(n)-2,2-bis(4-hydroxyphenyl)propane where "n" satisfies a relation of: $2.0 \leqq n \leqq 2.5$. These diol components serve to increase the glass transition temperature and to control the reaction more easily.

As the diol component, aliphatic diols such as ethylene glycol, diethylene glycol, 1,2-butanediol, 1,3-butanediol, 1,4-butanediol, neopentyl glycol, propylene glycol, or the like can also be used.

Of the components (3'), the trivalent or higher polycarboxylic acids, lower alkyl esters thereof and acid anhydrides thereof include, for example, 1,2,4-benzenetricarboxylic acid (trimellitic acid), 1,3,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxy)methane, 1,2,7,8-octanetetracarboxylic acid, empol trimer acid, monomethyl, monoethyl, dimethyl, and diethyl esters of these polycarboxylic acids, and the like.

Examples of the trihydric or higher polyhydric alcohols as the components (3') include sorbitol, 1,2,3,6-hexanetetrol, 1,4-sorbitan, pentaerythritol, dipentaerythritol, tripentaerythritol, sucrose, 1,2,4-butanetriol, 1,2,5-pentatriol, glycerol, diglycerol, 2-methylpropanetriol, 2-methyl-1,2,4-butanetriol, trimethylolethane, trimethylolpropane, 1,3,5-trihydroxymethylbenzene, and the like.

The amount of the trivalent or higher polyvalent monomers is preferably 1% by mole to 30% by mole, relative to the total amount of the monomer composition. If the amount is 1% by mole or less, the toner may have decreased anti-offset performance and deteriorated durability. If it is 30% by mole or more, the toner may have deteriorated image-fixing properties.

Among these trivalent or higher polyvalent monomers, benzenetricarboxylic acids, anhydrides, esters, and derivatives thereof are preferred. By using the benzenetricarboxylic acids or derivatives thereof, the toner can have both satisfactory image-fixing properties and high anti-offset performance.

These polyester resins and polyol resins are preferably not crosslinked or are weakly crosslinked and preferably have a content of THF-insoluble matters of 5% or less. If they are highly crosslinked, the resulting toner may not have satisfactory transparency and glossiness.

These binder resins can be prepared according to any procedure such as bulk polymerization, solution polymerization, emulsion polymerization, suspension polymerization, or the like.

(Charge Control Agents)

The toner of the present invention may further comprise a charge control agent according to necessity. Such charge control agents for use in the present invention include any known charge control agents such as nigrosine dyes, triphenylmethane dyes, chromium-containing metal complex dyes, molybdic acid chelate pigments, rhodamine dyes, alkoxyamines, quaternary ammonium salts including fluorine-modified quaternary ammonium salts, alkylamides, elementary substance or compounds of phosphorus, elementary substance or compounds of tungsten, fluorine-containing active agents, metal salts of salicylic acid, metal salts of salicylic acid derivatives, and the like. Specific examples of the charge control agents include commercially available products under the trade names of BONTRON 03 (nigrosine dyes), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product) available from Orient Chemical Industries Co., Ltd.; TP-302 and TP-415 (molybdenum complex of quaternary ammonium salt) available from Hodogaya Chemical Co., Ltd.; COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salt) available from Hoechst AG; LRA-901, and LR-147 (boron complex) available from Japan Carlit Co., Ltd.; as well as copper phthalocyanine pigments, perylene pigments, quinacridone pigments, azo pigments, and polymeric compounds having a functional group such as sulfonic group, carboxyl group, and quaternary ammonium salt.

The amount of the charge control agent is not specifically limited, can be set depending on the type of the binder resin, if any, additives, used according to necessity, and the process for preparing the toner including a dispersing process and is preferably from 0.1 part by weight to 10 parts by weight, and more preferably from 1 part by weight to 5 parts by weight, relative to 100 parts by weight of the binder resin. If the amount is more than 10 parts by weight, the toner may have excessively high charges, the charge control agent may not sufficiently play its role, the developer may have increased electrostatic attraction to a development roller, may have decreased fluidity or may induce decreased concentration of images. If it is less than 0.1 part by weight, the charge control agent cannot sufficiently exhibit its functions.

(Carriers)

The toner of the present invention can be used in a double-component developer in combination with a magnetic carrier. The amount of the toner in the developer is preferably from 1 part by weight to 10 parts by weight relative to 100 parts by weight of the carrier. Such magnetic carriers include, for example, conventional magnetic particles with a particle diameter of about 20 μm to about 200 μm, made of powdery iron, powdery ferrite, powdery magnetite, and magnetic resins.

Coating materials for use herein include, but are not limited to, amine resins such as urea-formaldehyde resin, melamine resin, benzoguanamine resin, urea resin, polyamide resin, epoxy resin, or the like; polyvinyl and polyvinylidene resins such as acrylic resin, poly(methyl methacrylate) resin, polyacrylonitrile resin, poly(vinyl acetate) resin, poly(vinyl alcohol) resin, poly(vinyl butyral) resin, polystyrene resin, styrene-acrylic copolymer resin, and other styrenic resins; halogenated olefin resins such as poly(vinyl chloride), or the like; polyester resins such as poly(ethylene terephthalate) resins, poly(butylene terephthalate) resins, or the like; polycarbonate resins; polyethylene resins; poly (vinyl fluoride) resins, poly(vinylidene fluoride) resins, polytrifluoroethylene resins, polyhexafluoropropylene resins, copolymers of vinylidene fluoride and acrylic monomer, vinylidene fluoride-vinyl fluoride copolymers, terpolymers of tetrafluoroethylene, vinylidene fluoride, and a non-fluorinated monomer, and other fluoroterpolymers; and silicone resins. The thickness of the resulting coating film is preferably 0.01 μm to 3 μm, and more preferably 0.1 μm to 0.3 μm. If the thickness is less than 0.01 μm, the coating film may not be satisfactorily formed, which fails to exhibit its function as a coating film. If it is more than 3 μm, no conductivity may be obtained.

The resin for use in the coating material may further comprise conductive powder according to necessity. Examples of the conductive powder include powders of metals, carbon black, titanium oxide, tin oxide, zinc oxide, and the like. The conductive powder preferably has an average particle diameter of 1 μm or less. If the average particle diameter is more than 1 μm, the electric resistance of the developer may not sufficiently be controlled.

The toner of the present invention can also be used as a single-component magnetic or non-magnetic toner without using a carrier.

(Magnetic Materials)

The toner of the present invention may further comprise a magnetic material and can be used as a magnetic toner. To use the toner as a magnetic toner, fine particles of a magnetic material may be contained in the toner. Examples of the magnetic materials include, but are not limited to, iron such as ferrite, magnetite, ferromagnetic metals, or the like, cobalt, nickel, and alloys thereof, compounds containing these elements; alloys which do not contain a ferromagnetic elements but show ferromagnetism by being subjected to an appropriate heat treatment, such as whistler alloys containing manganese and copper such as manganese-copper-aluminum alloys and manganese-copper-tin alloys; and chromium dioxide. The magnetic material is preferably uniformly dispersed in the toner in the state of a fine powder having an average particle diameter of 0.1 μm to 1 μm. The amount of the magnetic material is preferably from 10 parts by weight to 70 parts by weight, and more preferably from 20 parts by weight to 50 parts by weight, relative to 100 parts by weight of the resulting toner.

(Wax)

The toner or the developer of the present invention preferably comprises wax to thereby have good releasability in image-fixing procedure. In particular, when an oilless fixing device which does not require oil in an image-fixing unit is employed, the toner specifically preferably comprises wax. The wax has a melting point of preferably from 40° C. to 120° C. and more preferably from 50° C. to 110° C. If the wax has an excessively high melting point, the toner may have insufficient image-fixing properties at low temperature. If the wax has an excessively low melting point, the toner may have the decreased anti-offset performance and durability. The melting point of the wax can be obtained by differential scanning calorimetry (DSC). More specifically, several milligrams of a sample is heated at a constant heating rate, such as 10° C./min, and the melting peak obtained in this procedure is defined as the melting point. The content of the wax is preferably from 0 part by weight to 20 parts by weight, and more preferably from 0 part by weight to 10 parts by weight relative to 100 parts by weight of the toner.

Examples of the wax for use in the present invention include, but are not limited to, solid paraffin wax, microcrystalline wax, rice wax, fatty acid amide wax, fatty acid wax, aliphatic monoketones, fatty acid metal salt wax, fatty acid ester wax, partially saponified fatty acid ester wax, silicone varnish, higher alcohol, carnauba wax, and the like. In addition, low molecular weight polyethylenes, polypropylenes, and other polyolefins can be used as the wax component. Among them, polyolefins and esters having a softening point of 60° C. to 150° C., and more preferably 70° C. to 120° C. as obtained by a ball and ring method are preferred.

The toner more preferably comprises at least one wax selected from free-fatty-acid-free type carnauba wax having an acid value of 5 mgKOH/g or less, montan ester wax, oxidized rice wax having an acid value of 10 mgKOH/g to 30 mgKOH/g, and SASOL WAX.

The free-fatty-acid-free type carnauba wax is prepared by removing free fatty acids from material of carnauba wax and have an acid value of 5 mgKOH/g or less. These treated carnauba wax contain crystals having a smaller particle diameter than conventional carnauba wax and can be dispersed in a state of fine particles having an average particle diameter of 1 μm or less in the binder resin.

The montan ester wax is purified from minerals, have a smaller particle diameter and can be dispersed in a state of fine particles having an average particle diameter of 1 μm or less into the binder resin as in the treated carnauba wax. The montan ester wax preferably has an acid value of 5 mgKOH/g to 14 mgKOH/g.

The dispersed particles of the wax in the toner have a diameter of preferably 3 μm or less, more preferably 2 μm or less, and further preferably 1 μm or less. When the dispersed particles have a diameter of 3 μm or more, the resulting toner may have deteriorated durability at high temperature and in high humidity and decreased charging stability, although the wax flowability and releasability onto the transfer material increase.

The oxidized rice wax is prepared by oxidizing rice bran wax with the air. The oxidized rice wax preferably has an acid value of 10 mgKOH/g to 30 mgKOH/g. If the acid value is less than 10 mgKOH/g, the lower limit temperature of image fixing may increase to thereby deteriorate image-fixing properties at low temperature. If it is more than 30 mgKOH/g, the cold-offset temperature may increase to thereby deteriorate image-fixing properties at low temperature. Examples of the SASOL WAX include commercially available under the trade names of SASOL WAX H1, H2, A1, A2, A3, A4, A6, A7, A14, C1, C2, SPRAY30, SPRAY40, and the like available from Sasol. Among them, SASOL WAX H1, H2, SPRAY30, and SPRAY 40 are preferred for their high image-fixing properties at low temperature and high storage stability. Each of these waxes can be used either alone or in combination. The amount of the wax is preferably from 1 part by weight to 15 parts by weight, and more preferably from 2 parts by weight to 10 parts by weight, relative to 100 parts by weight of the binder resin.

(Cleaning Improvers)

The toner and the developer of the present invention preferably further comprise, or carry on a surface thereof, a cleaning improver to remove a residual developer on a photoconductor or a primary transfer medium after transfer. Examples of the cleaning improvers include, but are not limited to, metal salts of stearic acid and other fatty acids such as zinc stearate, and calcium stearate; and poly(methyl methacrylate) fine particles, polystyrene fine particles, and other fine polymer particles prepared by, for example, soap-free emulsion polymerization. Examples of the fine polymer particles preferably have a relatively narrow particle distribution and a volume-average particle diameter of 0.01 μm to 1 μm. The amount of the cleaning improver is preferably from 0.001 part by weight to 5 parts by weight, and more preferably from 0.001 part by weight to 1 part by weight relative to 100 parts by weight of the toner or the developer.

(Processes for Preparing Toners)

The toner of the present invention can be prepared according to any manufacturing process as long as it satisfies the conditions and the requirements.

For example, the toner can be prepared by a process including the steps of mechanically mixing a developer composition containing at least a binder resin, a main charge control agent and a pigment (coloring agent), melting and kneading the resulting mixture, pulverizing the kneaded article, and classifying the pulverized article. The manufacturing process may further comprise the step of recycling other powders than product particles obtained in the pulverizing step or in the classifying step to the step of mechanically mixing or the step of melting and kneading.

The term "the other powders (by-products) than the product particles" as used herein means fine particles or crude particles other than the product component having a set particle diameter obtained in the pulverizing step after the melting and kneading step, or fine particles or crude particles other than the product component having a set particle diameter obtained in the subsequent classifying step. These by-products are preferably mixed with the raw materials in the mixing step or in the melting and kneading step. The weight ratio of the by-products to the raw materials is preferably 1:99 to 50:50.

In the mixing step, the developer composition containing at least the binder resin, the main charge control agent, the pigment and the by-products, if any, can be mechanically mixed using a regular mixer such as one with a rotating blade under ordinary conditions. More preferably, the resin and the coloring agent have been mixed in advance.

After the completion of the mixing step, the resulting mixture is charged into a kneader and is melted and kneaded therein. Examples of the melting kneaders include, for example, single-screw or double-screw continuous kneaders, and roll-mill batch-system kneaders. These kneaders are commercially available, for example, as a double-screw extruder Model KTK from Kobe Steel Co., Ltd., a TEM series co-rotating double-screw extruder from TOSHIBA MACHINE Co., Ltd., a double-screw extruder from KCK Tool & Die, Co., a double-screw extruder Model PCM from Ikegai, Ltd., and a co-kneader from Buss Co., Ltd.

The melting and kneading step must be performed under appropriate conditions so as not to cause cleavage of molecular chains of the binder resin. More specifically, the melting and kneading temperature should be set in consideration of the softening point of the binder resin. If it is excessively lower than the softening point, the molecular chains of the binder resin are significantly cleaved. In contrast, if it is excessively higher than the softening point, the components may not be sufficiently dispersed. To control the amount of volatile components in the toner, it is preferable to set optimum conditions of the temperature, time, and atmosphere of the melting and kneading step while monitoring the amount of residual volatile components.

After the compression of the melting and kneading step, the resulting kneaded product is pulverized. The pulverizing step preferably comprises a step of roughly pulverizing the kneaded product and a step of finely pulverizing the roughly pulverized article. The pulverizing process is preferably performed according to a collision pulverization process in which the article is allowed to collide with a breaker disc in a jet stream to be pulverized or a rotor pulverization process in which the article is pulverized in a narrow gap between a mechanically rotating rotor and a stator. Such collision pulverizers include, for example, hammer mills, boll mills, tube mills, vibrating mills, and the like. As jet pulverizers mainly comprising compressed air and a breaker disc, Type I and Type IDS collision pulverizers available from Nippon Pneumatic MFG. Co., Ltd., are preferably used. Examples of the rotor pulverizers include roll mills, pin mills, and fluidized bed type jet mills. Among them, systems mainly comprising a fixed container serving as an outer wall and a rotor having the same axis as the fixed container are preferred. Such rotor pulverizers of this type are commercially available under the trade names of Turbo-Mill from Turbo Kogyo Co., Ltd., Cryptron from Kawasaki Heavy Industries, Co., Ltd., and Fine Mill from Nippon Pneumatic MFG. Co., Ltd. To manufacture more spherical toner particles, rotor pulverizers are preferably used.

After the completion of the pulverizing step, the pulverized product is classified in a gas stream by action of, for example, centrifugal force to thereby manufacture toner particles (base particles) having a set particle diameter such as a volume-average particle diameter of 1 μm to 20 μm. The volume-average particle diameter of the toner particles is preferably from 1 μm to 6 μm to prevent transfer dust in toner transferring and image-fixing procedures and to enable the toner to exhibit sufficient colorability. The toner having such a preferred volume-average particle diameter can effectively avoid scattering of toner particles and toner deposition on the background of images and can achieve high image quality, low production cost and a desired coverage with the external additive. The volume-average particle diameter can be measured using, for example, an instrument COULTER TA available from COULTER ELECTRONICS, INC.

To further improve the fluidity, storage stability, developing properties, and transfer properties of the toner, the aforementioned oxide fine particles, hydrophobic silica fine particles, and other inorganic fine particles may be added to the above-prepared toner. These external additives can be mixed with the toner particles using a regular mixer for powders. The mixer for use herein preferably has a jacket or another unit to control its inner temperature. To change the hysteresis of a load applied to the external additive, the external additive may be added in the course of the mixing step or sequentially during the mixing step. Alternatively, the number of revolutions, the speed of tumbling, time period, and temperature of the mixer can be changed to change the hysteresis of the load. It is acceptable that a relatively high load is applied at early stages, and a relatively low load is then applied, or they can be applied in a retrograde order.

Examples of mixing systems for use herein are V mixers, rocking mixers, LEDIGE MIXERS, NAUTA MIXERS, HENSCHEL MIXERS, and the like.

The toner can also be prepared by a polymerization process or a capsulation process. These processes will be schematically described below.

(Polymerization Process)

(1) A polymerizable monomer, a low-molecular-weight polymer, and where necessary a polymerization initiator, a coloring agent and other components are granulated in an aqueous dispersion medium.

(2) The granulated monomer composition particles are classified into an appropriate particle diameter.

(3) The monomer composition particles having a specific particle diameter are polymerized.

(4) The dispersing agent (dispersion medium) is removed by an appropriate treatment, and the resulting polymerization product is subjected to filtration, washing with water, and drying to thereby form base particles.

(Capsulation Process)

(1) A resin, and a coloring agent and other necessary components are kneaded, for example, using a kneader to thereby manufacture a molten toner core.

(2) The toner core material is placed in water and is strongly stirred to thereby manufacture core fine particles.

(3) The core fine particles are placed in a solution of a shell material, then are stirred and are treated with a poor solvent added dropwise to cover the surface of the core material with the shell material to thereby form capsules.

(4) The capsules are filtrated and dried to manufacture yield base particles.

The full-color toner kit for developing a latent electrostatic image of the present invention includes a magenta toner, a yellow toner, and a cyan toner. One of the magenta toner, the yellow toner, and the cyan toner is the toner for developing a latent electrostatic image of the present invention.

(Intermediate Transfer)

An intermediate transfer can be used in a transfer system according to the present invention. A first embodiment of the intermediate transfer will be described below.

FIG. 1 is a schematic diagram of a copying machine (copier) containing the intermediate transfer according to the first embodiment. The copier includes a photoconductive drum such as photoconductor 10 serving as a latent electrostatic image support. The arranged around the photoconductor 10 are a charge roller 20 as a charging device, an exposing device 30, a cleaning unit 60 including a cleaning blade, a discharge lamp or discharger 70, an image developer 40, and a transfer belt 50 playing the role of an intermediate transfer. The intermediate transfer 50 is spanned over a plurality of rollers 51 and driven by a motor or similar driving unit (not shown) in the direction indicated by an arrow in FIG. 1. One of the rollers 51 serves as a bias roller for applying a bias for image transfer to the intermediate transfer 50. A power supply (not shown) applies a preset voltage for image transfer to the above roller. A cleaning unit 90 for cleaning the intermediate transfer 50 includes a cleaning blade. A transfer roller or transfer 80 faces the intermediate transfer 50 and transfers a toner image from the intermediate transfer 50 to a paper or similar transferring medium 100 serving as a recording medium. A power supply (not shown) applies a bias for image transfer to the transfer roller 80. A corona charger or charge applier 52 is arranged around the intermediate transfer 50.

The image developer 40 includes a developer carrier arranged as an endless developing belt 41. A Bk (black) developing unit 45K, a Y (yellow) developing unit 45Y, an M (magenta) developing unit 45M and a C (cyan) developing unit 45C are arranged side by side in the vicinity of the developing belt 41. The developing belt 41 is spanned over a plurality of rollers and driven by a motor or similar drive means (not shown) in the direction indicated by an arrow in FIG. 1. At a position where the developing belt 41 comes in contact with the photoconductor 10, the developing belt 41 moves at substantially the same speed as the photoconductor 10.

The Bk, Y, M and C developing units 45Bk, 45Y, 45M, and 45C have identical configuration each other. The following description will concentrate on the Bk developing unit 45Bk by way of example. The other developing units 45Y, 45M and 45C are simply distinguished from the developing unit 45Bk by suffixes Y. M and C attached to the reference numerals. The Bk developing unit 45Bk includes a developer tank 42Bk storing a viscous, dense liquid developer comprising toner particles and liquid carrier. A scoop roller 43Bk has its lower portion immersed in the liquid developer stored in the tank 42Bk. A conductive applicator roller 44Bk applies the liquid developer scooped up by the roller 43Bk to the developing belt 41 in the form of a thin layer. A power supply (not shown) applies a set bias to the applying roller 44Bk.

Figure 2:
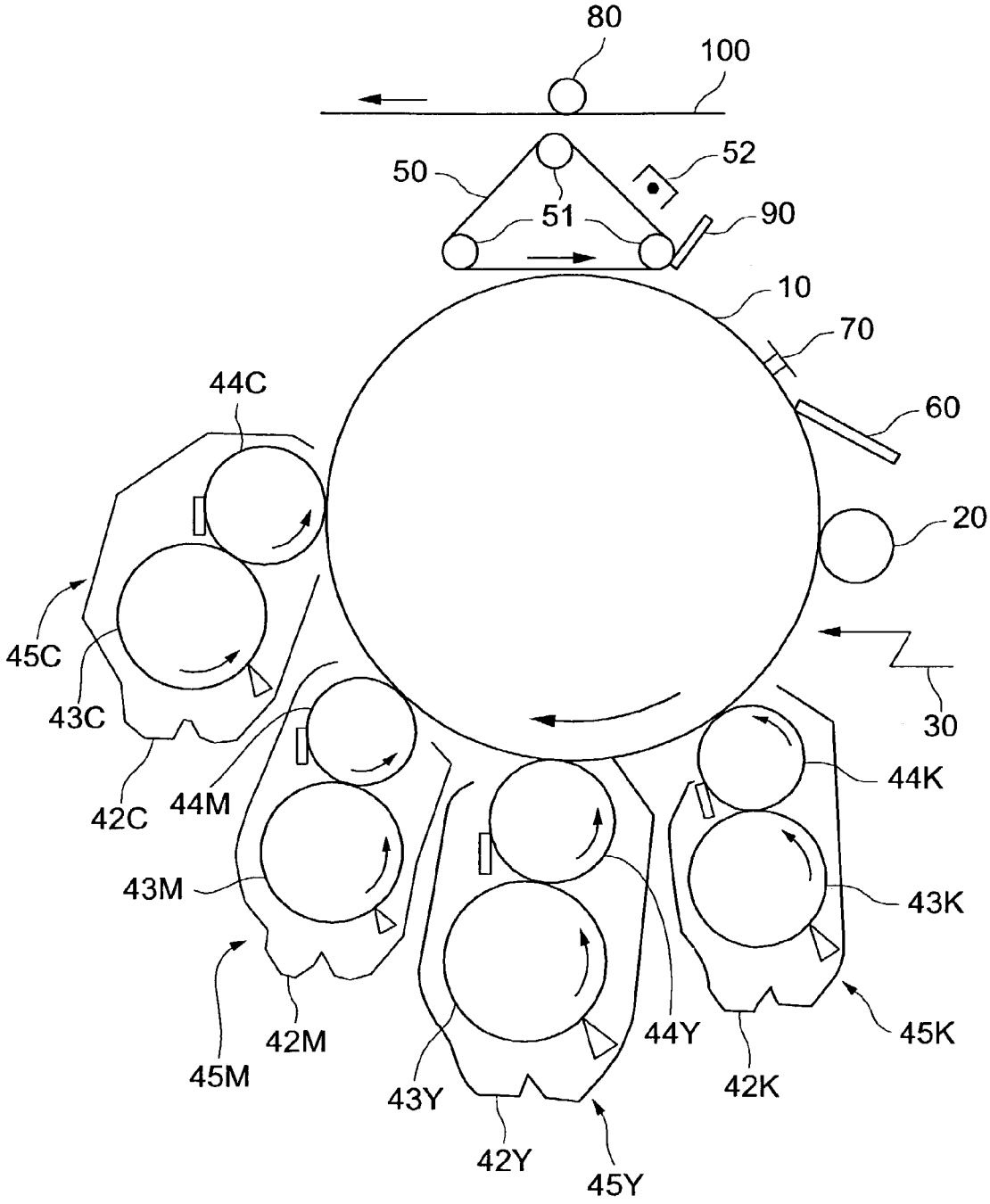
FIG. 2 is a schematic diagram showing another example of the image-forming apparatus (copying machine) of the present invention.

The developing units 45Bk, 45Y, 45M and 45C may also be sequentially arranged around the photoconductor 10, as shown in FIG. 2.

The operation of the copying machine according to this embodiment will be described below.

With reference to FIG. 1, the photoconductor 10 is rotated and moved in the direction indicated by the arrow and is uniformly charged by the charge roller 20. Thereafter, the exposing device 30 focuses a reflected light from an original paper using its optical system (not shown) onto the photoconductor 10 to thereby form a latent electrostatic image on the photoconductor 10. The image developer 40 visualizes the latent electrostatic image so as to form a visible toner image as a developed image. The thin layer formed of the developer on the developing belt 41 is brought into contact with the photoconductor 10 in a development area, is separated from the developing belt 41 and moves to a region bearing the image on the photoconductor 10. The toner image developed by the image developer 40 is transferred to the surface of the intermediate transfer 50 in an area (primary transfer area) in contact with the intermediate transfer 50 which moves at the same speed as the photoconductor 10 in a primary transfer step. To obtain an image on which three or four colors are sequentially disposed, this primary transfer step is repeated for each of the colors to thereby form a color image on the intermediate transfer 50.

To apply charges to the sequentially disposed composite toner image on the intermediate transfer 50, the corona charger 52 is arranged downstream in a contact area between the photoconductor 10 and the intermediate transfer 50 in a direction that the intermediate transfer 50 rotates and upstream in a contact area between the intermediate transfer 50 and the transferring medium 100. The corona charger 52 applies a true electric charge to the toner image so as to sufficiently charge the toner image to be transferred to the transferring medium 100, in which true electric charge has the same polarity as that of the charged toner particles constituting the toner image. The entire toner image is thus charged by the corona charger 52 and is transferred by action of the transfer bias applied from the transfer roller 80 to the transferring medium 100 transported in a direction indicated by the arrow from a sheet supply unit (not shown) in a secondary transfer procedure. The transferring medium 100 bearing the transferred toner image is separated from the photoconductor 10 by action of a separation device (not shown), is subjected to image-fixing in an image-fixing device (not shown) and is then ejected from the copying machine. Untransferred toners on the photoconductor 10 after the transferring procedure are recovered and removed by the cleaning device 60, followed by elimination of residual charges by the eliminating lamp 70 to be subjected to another charging procedure.

The intermediate transfer has a coefficient of static friction of preferably 0.1 to 0.6, and more preferably 0.3 to 0.5 and has a volume resistivity of several ohm-centimeters or more and thousand ohm-centimeters or less. Such a volume resistivity within this range can prevent the intermediate transfer itself from charging and can prevent the charges applied by the charging means from remaining on the intermediate transfer. Thus, irregular or uneven transferring in the secondary transfer process can be prevented and the transfer bias in the secondary transfer process can be easily applied.

Materials for the intermediate transfer are not specifically limited and include any known or conventional materials. Examples of the material for the intermediate transfer are as follows.

(1) The intermediate transfer may be a single-layer belt comprising a material having a high Young's modulus (modulus of elasticity in tension). Such materials having a high Young's modulus include, for example, polycarbonates (PCs), poly(vinylidene fluoride) (PVDF), poly(alkylene terephthalate) (PAT), blends of a polycarbonate (PC) and a poly(alkylene terephthalate) (PAT), blends of an ethylene-tetrafluoroethylene copolymer (ETFE) and a PC, blends of ETFE and PAT, blends of PC and PAT, and thermosetting polyimides containing dispersed carbon black. The resulting single-layer belt having a high Young's modulus less deforms under the application of a stress in the image forming procedure and yields less misregistration particularly in the formation of color images.

(2) The intermediate transfer may also be a two- or three-layer belt comprising the belt having a high Young's modulus as a base layer, and a surface layer and/or an intermediate layer arranged on the periphery of the base layer. The two- or three-layer belt can prevent dropouts of line images due to the stiffness or rigidity of a single-layer belt.

(3) The intermediate transfer may also be a belt comprising a rubber and/or an elastomer and having a relatively low Young's modulus. This belt causes substantially no dropout of a line image, owing to its softness (flexibility). By setting the width of the belt larger than those of the driving roll and suspension roll, the belt can prevent itself from jetting using elasticity of protruded portions of the belt protruded from the rolls and can thereby achieve low cost without the use of ribs or a jetting prevention mechanism.

Intermediate transfer belts comprising any of fluororesin, polycarbonate resin, and polyimide resin have been conventionally used as the intermediate transfer. Recently, elastic belts comprising an elastic member partially or entirely have also been used. Image transfer step of color images using resinous belts have the following problems.

Namely, four color toners serve to form a color image in general. One color image has one to four of toner layers. The toner layers are applied with a pressure to thereby have increased adhesion or cohesion among toner particles while undergoing the primary transfer step (transfer from the photoconductor to the intermediate transfer belt) and the secondary transfer step (transfer from the intermediate transfer belt to the transferring medium). Such increased adhesion among the toner particles frequently causes dropouts of characters or edge missing of solid images. The resinous belt has high stiffness or rigidity, is resistant to deformation with respect to the toner layers and serves to compress the toner layers, thus inviting aforementioned problems.

A demand has been made on forming such a full color image on various types of paper such as Japanese paper, embossed paper, or paper having irregular surface. However, such paper having low smoothness often causes gaps with respect to the toner during transfer procedure, thus inviting transfer dropout. If the transfer pressure in the secondary transfer unit is increased to thereby improve adhesion, the toner layers have increased cohesion among the toner particles, thus inviting dropouts of characters.

In contrast, the elastic belt can deform according to the toner layers and rough paper in the transfer unit. In other words, the elastic belt can deform following to local protrusions and depressions, can achieve good adhesion and can thereby yield satisfactorily transferred images uniformly even on such rough paper without dropouts of characters.

Materials for the elastic belt include, but are not limited to, resins such as polycarbonates, fluororesins such as ETFE and PVDF, polystyrenes, chloropolystyrens, poly(α-methylstyrene), styrene-butadiene copolymers, styrene-vinyl chloride copolymers, styrene-vinyl acetate copolymers, styrene-maleic acid copolymers, styrene-acrylate copolymers such as styrene-methyl acrylate copolymers, styrene-ethyl acrylate copolymers, styrene-butyl acrylate copolymers, styrene-octyl acrylate copolymers, and styrene-phenyl acrylate copolymers, styrene-methacrylate copolymers such as styrene-methyl methacrylate copolymers, styrene-ethyl methacrylate copolymers, and styrene-phenyl methacrylate copolymers, styrene-methyl α-chloroacrylate copolymers, styrene-acrylonitrile-acrylate copolymers, and other styrenic resins (homopolymers and copolymers containing styrene or a substituted styrene), methyl methacrylate resins, butyl methacrylate resins, ethyl acrylate resins, butyl acrylate resins, modified acrylic resins such as silicone-modified acrylic resins, vinyl-chloride-modified acrylic resins, and acrylic-urethane resins, vinyl chloride resins, styrene-vinyl acetate copolymers, vinyl chloride-vinyl acetate copolymers, rosin-modified maleic acid resins, phenolic resins, epoxy resins, polyester resins, polyester polyurethane resins, polyethylenes, polypropylenes, polybutadienes, poly(vinylidene chloride), ionomer resins, polyurethane resins, silicone resins, ketone resins, ethylene-ethyl acrylate copolymers, xylene resins, poly(vinyl butyral) resins, polyamide resins, and modified polyphenylene oxide resins. Each of these resins can be used either alone or in combination.

The materials for the elastic belt further include elastic rubbers and elastomers. Examples of the elastic rubbers and the elastomers include, but are not limited to, butyl rubber, fluororubber, acrylic rubber, ethylene-propylene rubber (EPDM), acrylonitrile-butadiene rubber (NBR), acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylenes, chlorinated polyethylenes, urethane rubber, syndiotactic 1,2-polybutadiene, epichlorohydrin rubber, silicone rubber, fluororubber, polysulfide rubber, polynorbornene rubber, hydrogenated nitrile rubber, thermoplastic elastomers such as polystyrene elastomers, polyolefin elastomers, poly(vinyl chloride) elastomers, polyurethane elastomers, polyamide elastomers, polyurea elastomers, polyester elastomers, and fluororesin elastomers. Each of these substances can be used either alone or in combination.

The intermediate transfer belt may further comprise a conducting agent for controlling the resistivity. Such conducting agents are not specifically limited and include, for example, carbon black, graphite, powders of aluminum, nickel, and other metals, tin oxide, titanium oxide, antimony oxide, indium oxide, potassium titanate, antimony-tin complex oxide (ATO), indium-tin complex oxide (ITO), and other conductive metal oxides. These conductive metal oxides may be covered with insulative fine particles such as barium sulfate, magnesium silicate, and calcium carbonate fine particles.

The surface layer of the intermediate transfer belt and the material thereof must prevent contamination or deposition of the elastic material to the photoconductor and must reduce the surface frictional resistance of the surface. Specifically, they must reduce the adhesion of the toner to thereby satisfactorily perform the cleaning and secondary transfer procedures. Accordingly, the surface layer may comprise, for example, a matrix comprising one or more of polyurethanes, polyesters, and epoxy resins and one or more materials for reducing the surface energy and increasing smoothness dispersed in the matrix. Such materials may be powders and particles of fluororesins, fluorine compounds, carbon fluoride, titanium dioxide, and silicon carbide and may preferably have varying particle diameters. Alternatively, a fluorine rubber is subjected to heat treatment to thereby form a layer rich in fluorine in the surface of the belt to thereby reduce the surface energy.

Preparation processes of the belt are not specifically limited and include, for example:

a centrifugal molding process in which materials are placed in a rotating cylindrical mold to form a belt;

a spray coating process in which a liquid coating composition is sprayed to form a film;

a dipping process in which a cylindrical mold is dipped in a solution of the material and is then pulled out;

an injection process in which a material composition is injected into an inner mold or an outer mold; and a process in which a compound is placed around a cylindrical mold and is subjected to vulcanization and polishing.

Two or more of these processes are generally employed in combination to form the belt. Other processes can also be employed.

To prevent elongation of the elastic belt, a rubber layer may be formed on, above, or below a core resin layer with less elongation, or a material for preventing the elongation may be contained in the core layer. The preparation process thereof is not specifically limited.

Materials for the core layer for preventing elongation include, but are not limited to, cotton, silk, and other natural fibers; polyester fibers, nylon fibers, acrylic fibers, polyolefin fibers, poly(vinyl alcohol) fibers, poly(vinyl chloride) fibers, poly(vinylidene chloride) fibers, polyurethane fibers, polyacetal fibers, polyfluoroethylene fibers, phenol fibers, and other synthetic fibers; carbon fibers, glass fibers, boron fibers, and other inorganic fibers; iron fibers, copper fibers, and other metallic fibers. Woven or knitted fabrics, threads and yarns formed from one or more of such materials can be used.

The yarns can be single twist yarns, plied yarns, two ply yarns, and other strands of one or plural filaments twisted by any twisting procedure. The yarns can also be a blending of plural fibers selected from the materials above. The yarns can be subjected to an appropriate conducting treatment before use.

The woven or knitted fabrics can be looped fabrics and any other woven or knitted fabrics. They can be union fabrics and can be subjected to a conducting treatment before use.

Preparation processes for the core layer are not specifically limited and include, for example, a process in which a cylindrically woven fabric covers a mold, and a coating layer is formed on the woven fabric; a process in which a cylindrically woven fabric is dipped in a liquid rubber to thereby form a coating layer on one or both sides of the core layer; and a process in which a yarn is spirally placed around a mold at an optional pitch, and a coating layer is formed on the yarn.

The elastic layer may preferably have a relatively small thickness, for example, around 1 mm or less, depending on the hardness of the elastic layer. If the thickness is excessively large, the surface layer may undergo cracking and the resulting images may elongate excessively due to large elongation of the elastic layer.

(Tandem Color Image Forming Apparatus)

A tandem color image forming apparatus as an embodiment of the present invention will be described below. The term "image developer," refers to a developing device to develop a latent electrostatic image with developer.

Figure 3:
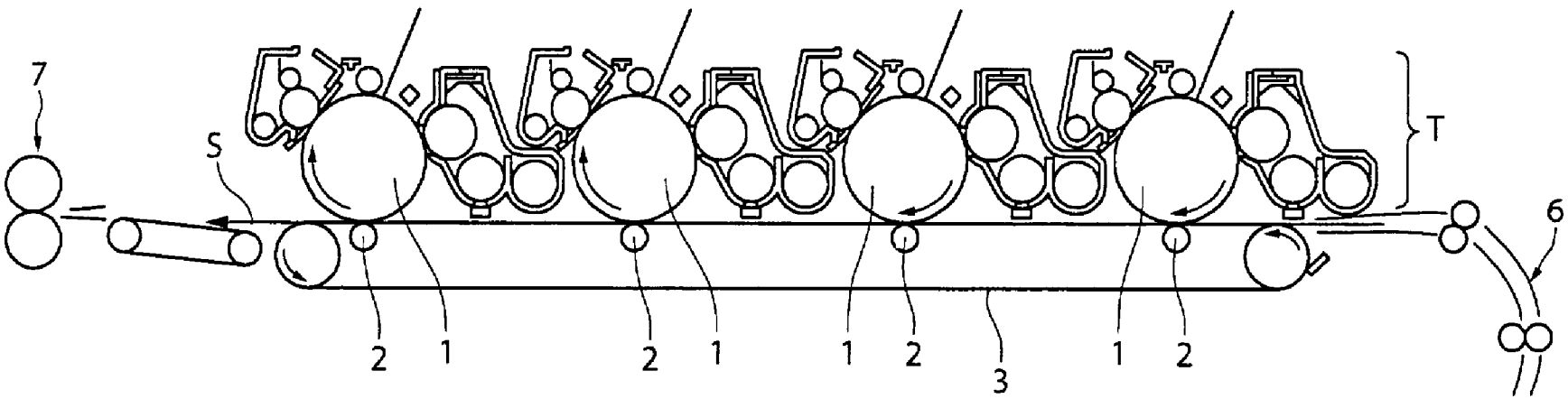
FIG. 3 is a schematic diagram showing an example of the color image forming apparatus of a tandem direct transfer system of the present invention.
Figure 4:
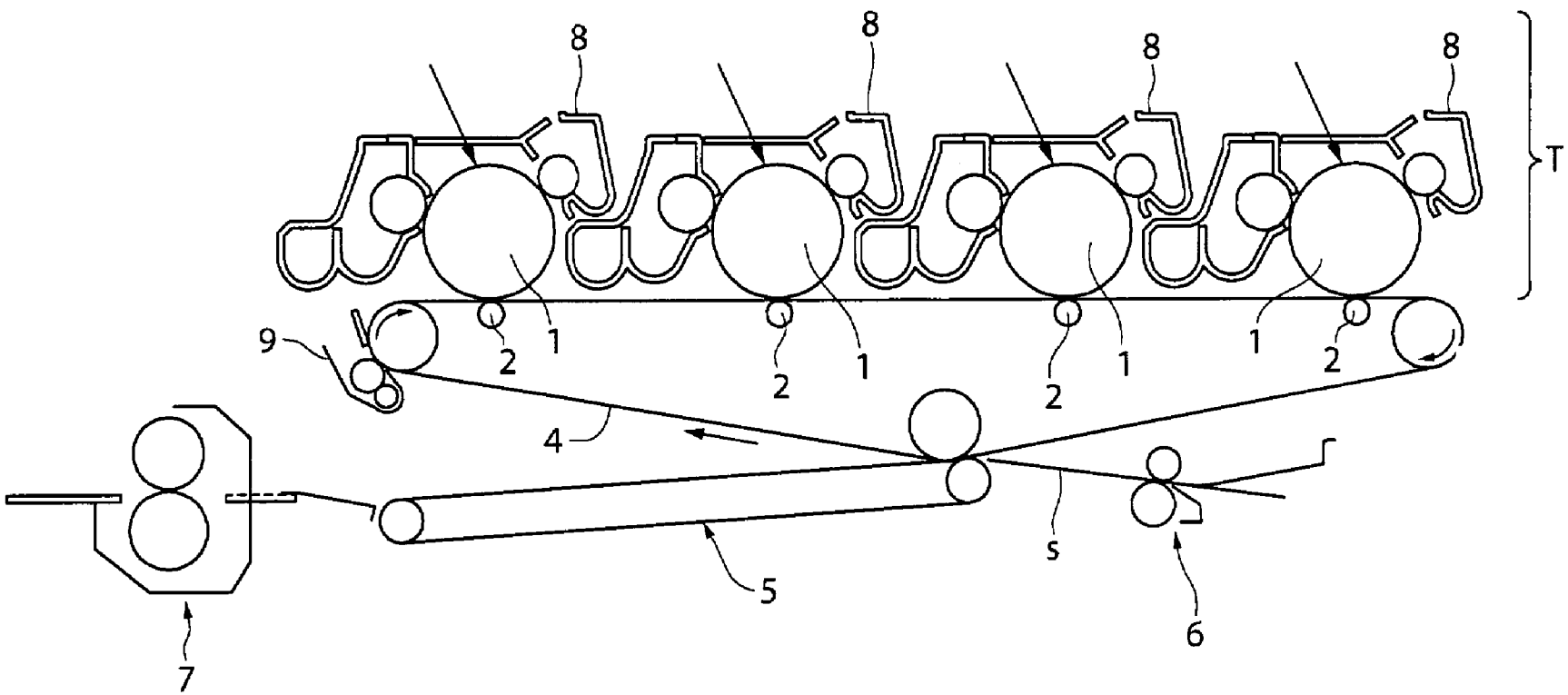
FIG. 4 is a schematic diagram showing another example of the color image forming apparatus of a tandem direct transfer system of the present invention.

Such tandem apparatus for developing a latent electrostatic image are roughly classified into a direct transfer system and an indirect transfer system. In the direct transfer system as shown in FIG. 3, a transfer device 2 sequentially transfers images on individual photoconductors 1 to a sheet "s" transported by a sheet conveyer belt 3. In the indirect transfer system as shown in FIG. 4, a primary transfer device 2 sequentially transfers images on individual photoconductors 1 to an intermediate transfer 4, and a secondary transfer device 5 transfers the resulting images on the intermediate transfer 4 to a sheet "s" in one process. The transfer device 5 may be in the form of a transfer conveyer belt or a roller.

The direct transfer system must comprise a sheet feeder 6 upstream to the sequentially arranged photoconductors 1 of the tandem image-forming apparatus "T" and an image-fixing device 7 downstream of the tandem image-forming apparatus "T." The system inevitably increases in its size in a direction of sheet conveying.

In contrast, in the indirect transfer system, the secondary transfer mechanism can be relatively freely arranged, and the sheet feeder 6 and the image-fixing device 7 can be arranged above and/or below the tandem image-forming apparatus T. The apparatus with the indirect transfer system can therefore be downsized.

In the direct transfer system, the image-fixing device 7 should be arranged in the vicinity of the tandem image-forming apparatus T to prevent upsizing of the apparatus in a sheet conveying direction. The sheet "s" cannot sufficiently be bent in such a small space between the image-fixing device 7 and the tandem image-forming apparatus T. Accordingly, image formation on an upstream of a sheet to the image-fixing device 7 is affected by an impact, specifically in a case of a thick sheet, formed when the tip of the sheet "s" enters the image-fixing device 7 and by the difference between the conveying speed of the sheet when it is transported through the image-fixing device 7 and the conveying speed of the sheet by the transfer conveyor belt.

In contrast, in the indirect transfer system, the sheet "s" can be sufficiently bent in a space between the image-fixing device 7 and the tandem image-forming apparatus T. Thus, the image-fixing device 7 does not significantly affect the image-forming.

For these reasons, tandem developing apparatus for developing a latent electrostatic image with the indirect transfer system have become a focus of attention.

In the color latent electrostatic image developing device of this type as shown in FIG. 4, a photoconductor cleaning device 8 removes residual toners on the photoconductor 1 after transferring, and cleans the surface of the photoconductor 1 for another image forming procedure. In addition, an intermediate transfer medium cleaning device 9 removes a residual toner on the intermediate transfer 4 after the secondary transfer process to thereby clean the surface of the intermediate transfer 4 for another image forming procedure.

Some other embodiments of the present invention will be described below with reference to the attached drawings.

Figure 5:
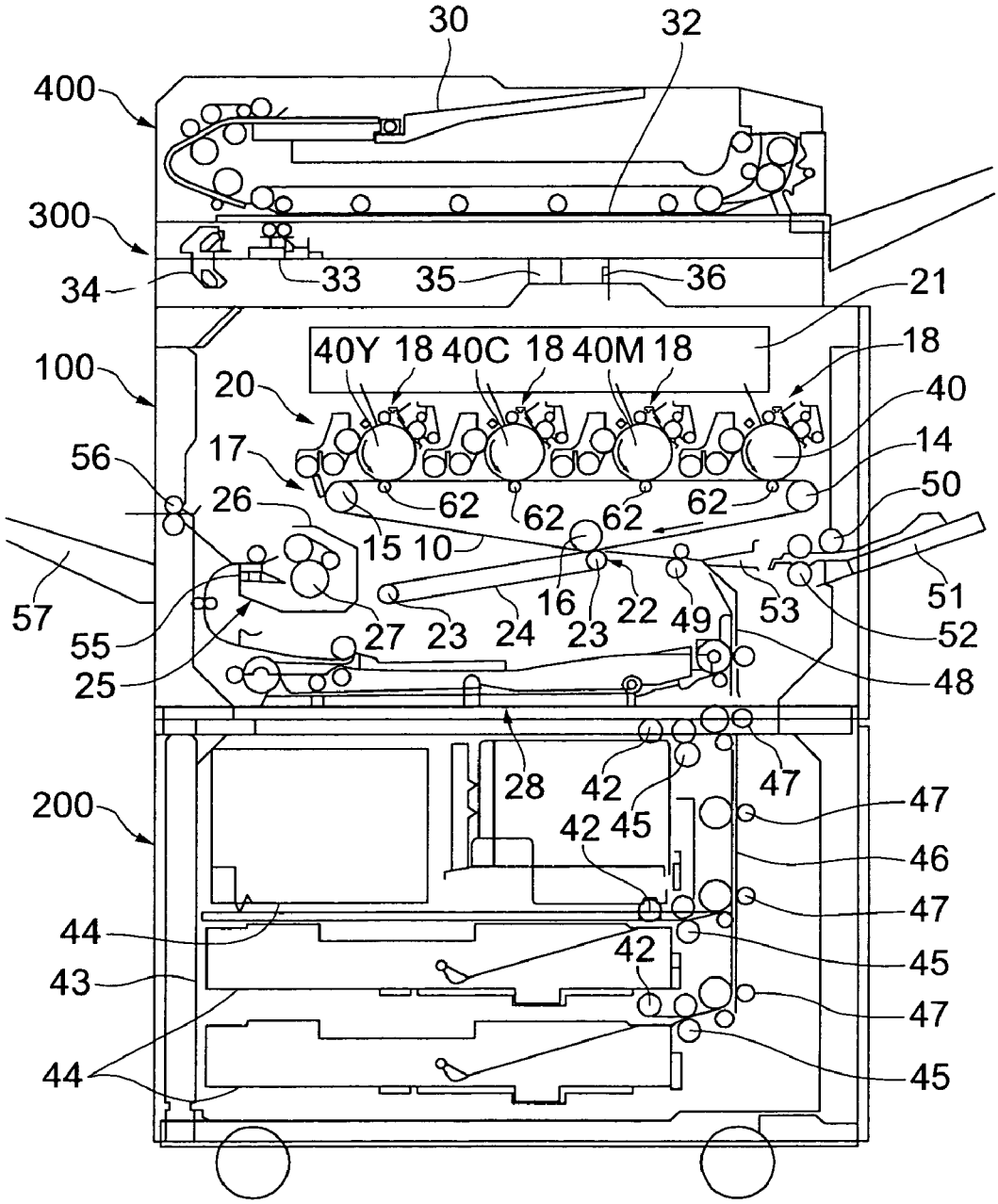
FIG. 5 is a schematic diagram showing an example of an image developer with a tandem indirect transfer system for developing a latent electrostatic image, according to the present invention.

FIG. 5 is a schematic diagram of a latent electrostatic image developing apparatus with the tandem indirect transfer system as an embodiment of the present invention. The apparatus includes a copying machine main body 100, a paper feeder table 200 on which the copying machine main body 100 is placed, a scanner 300 arranged on the copying machine main body 100, and an automatic document feeder (ADF) 400 arranged on the scanner 300. The copying machine main body 100 includes an endless-belt intermediate transfer 10.

The intermediate transfer 10 shown in FIG. 5 is spanned around three support rollers 14, 15 and 16 and is capable of rotating and moving in a clockwise direction in the figure.

This apparatus includes an intermediate transfer cleaning device 17 on the left side of the second support roller 15. The intermediate transfer cleaning device 17 is capable of removing a residual toner on the intermediate transfer 10 after transferring an image.

Above the intermediate transfer 10 spanned between the first and second support rollers 14 and 15, yellow, cyan, magenta, and black image-forming unit 18 are arrayed in parallel in direction that the intermediate transfer 10 moves, to thereby constitute a tandem image forming unit 20.

The apparatus further includes an exposing device 21 above the tandem image forming unit 20 and a secondary transfer device 22 below the intermediate transfer 10 as shown in FIG. 5. The secondary transfer device 22 shown in FIG. 5 comprises an endless belt serving as a secondary transfer belt 24 spanned around two rollers 23. The secondary transfer belt 24 is pressed on the third support roller 16 with the interposition of the intermediate transfer 10 and is capable of transferring an image on the intermediate transfer 10 to a sheet.

An image-fixing device 25 is arranged on the left side of the secondary transfer device 22 and is capable of fixing a transferred image on the sheet. The image-fixing device 25 comprises an endless image-fixing belt 26 and a pressure roller 27 pressed on the image-fixing belt 26.

The secondary transfer device 22 is also capable of transporting a sheet to the image-fixing device 25, after transferring an image. Naturally, a transfer roller or a non-contact charger can be used as the secondary transfer device 22. In this case, the secondary transfer device 22 may not be capable of transporting the sheet.

The apparatus shown in FIG. 5 also includes a sheet reverser 28 below the secondary transfer device 22 and the image-fixing device 25 in parallel with the tandem image forming unit 20. The sheet reverser 28 is capable of reversing the sheet so as to form images on both sides of the sheet.

A copy is made using the color latent electrostatic developing apparatus in the following manner. Initially, a document is placed on a document platen 30 of the automatic document feeder 400. Alternatively, the automatic document feeder 400 is opened, the document is placed on a contact glass 32 of the scanner 300, and the automatic document feeder 400 is closed to press the document.

At the push of a start switch (not shown), the document, if any, placed on the automatic document feeder 400 is transported onto the contact glass 32. When the document is initially placed on the contact glass 32, the scanner 300 is immediately driven to operate a first carriage 33 and a second carriage 34. Light is applied from a light source to the document, and reflected light from the document is further reflected toward the second carriage 34 at the first carriage 33. The reflected light is further reflected by a mirror of the second carriage 34 and passes through an image-forming lens 35 into a read sensor 36 to thereby read the document.

At the push of the start switch (not shown), a drive motor (not shown) rotates and drives one of the support rollers 14, 15 and 16 to thereby allow the other two support rollers to followingly rotate to thereby rotatively convey the intermediate transfer 10. Simultaneously, each of the image-forming unit 18 rotates the photoconductors 40 to thereby form black, yellow, magenta, and cyan monochrome images on the photoconductors 40, respectively. With the conveying intermediate transfer 10, the monochrome images are sequentially transferred to form a composite color image on the intermediate transfer 10.

Separately at the push of the start switch (not shown), one of feeder rollers 42 of the feeder table 200 is selectively rotated, sheets are ejected from one of multiple feeder cassettes 44 in a paper bank 43 and are separated in a separation roller 45 one by one into a feeder path 46, are transported by a transport roller 47 into a feeder path 48 in the copying machine main body 100 and are bumped against a resist roller 49.

Alternatively, the push of the start switch rotates a feeder roller 50 to eject sheets on a manual bypass tray 51, the sheets are separated one by one on a separation roller 52 into a manual bypass feeder path 53 and are bumped against the resist roller 49.

The resist roller 49 is rotated synchronously with the movement of the composite color image on the intermediate transfer 10 to transport the sheet into between the intermediate transfer 10 and the secondary transfer device 22, and the composite color image is transferred onto the sheet by action of the secondary transfer device 22 to thereby form a color image.

The sheet bearing the transferred image is transported by the secondary transfer device 22 into the image-fixing device 25, is applied with heat and pressure in the image-fixing device 25 to fix the transferred image, changes its direction by action of a switch blade 55, is ejected by an ejecting roller 56 and is stacked on an output tray 57. Alternatively, the sheet changes its direction by action of the switch blade 55 into the sheet reverser 28, is reversed therein, is transported again to the transfer position, followed by image formation on the backside of the sheet. The sheet bearing images on both sides thereof is ejected through the ejecting roller 56 onto the output tray 57.

Apart from this, the intermediate transfer cleaning device 17 removes residual toners on the intermediate transfer 10 after image transfer for another image forming procedure by the tandem image forming unit 20.

The resist roller 49 is generally grounded, but it is also acceptable to apply a bias thereto for the removal of paper dust of the sheet.

Figure 6:
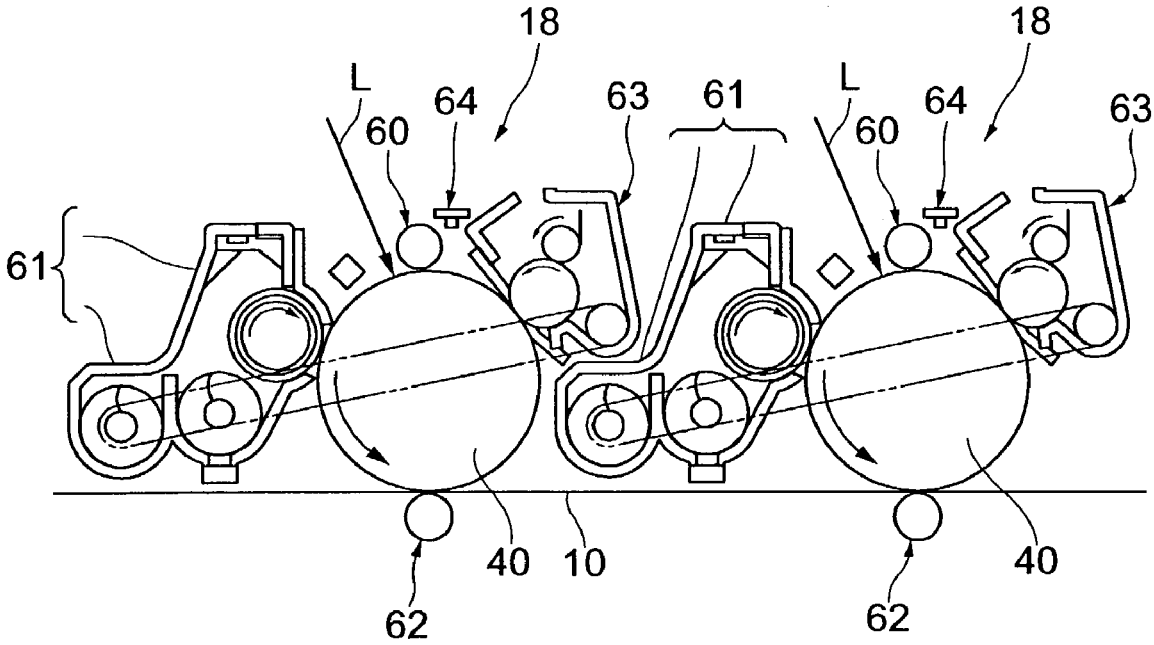
FIG. 6 is an enlarged schematic diagram showing an example of an image-forming unit of the image developer for developing a latent electrostatic image shown in FIG. 5.

Each of the image forming unit 18 in the tandem image forming unit 20 comprises the drum-shaped photoconductor 40 which serves as a latent electrostatic image support, as well as a charger 60, a image developer 61, a primary transfer device 62, a photoconductor cleaning device 63,a discharger 64, and other components arranged around the photoconductor 40 according to necessity, as shown in FIG. 6.

(Image-Forming Process Cartridge)

The image-forming process cartridge of the present invention comprises the developer of the present invention, an image developer configured to have a developer container, and to supply the developer of the present invention to a latent electrostatic image, so as to visualize the latent electrostatic image and form a toner image, and one of a latent electrostatic image support, a charger configured to charge a surface of the latent electrostatic image uniformly, and a cleaner configured to clean the surface of the latent electrostatic image support. The image-forming process cartridge is formed in one-piece construction, and is attachable to and detachable from an image-forming apparatus. The image-developer in the image-forming process cartridge of the present invention contains the developer of the present invention. The developer contains the toner for developing a latent electrostatic image of the present invention.

The image-forming process cartridge of the present invention exhibits satisfactory charging properties when incorporated in an image-forming apparatus. The image-forming process cartridge of the present invention also enables forming an image, on which few of the toners are weakly or inversely charged, and none of the toners are scattered, even after several tens of thousands of sheets are printed at high temperature and in high humidity.

Figure 7:
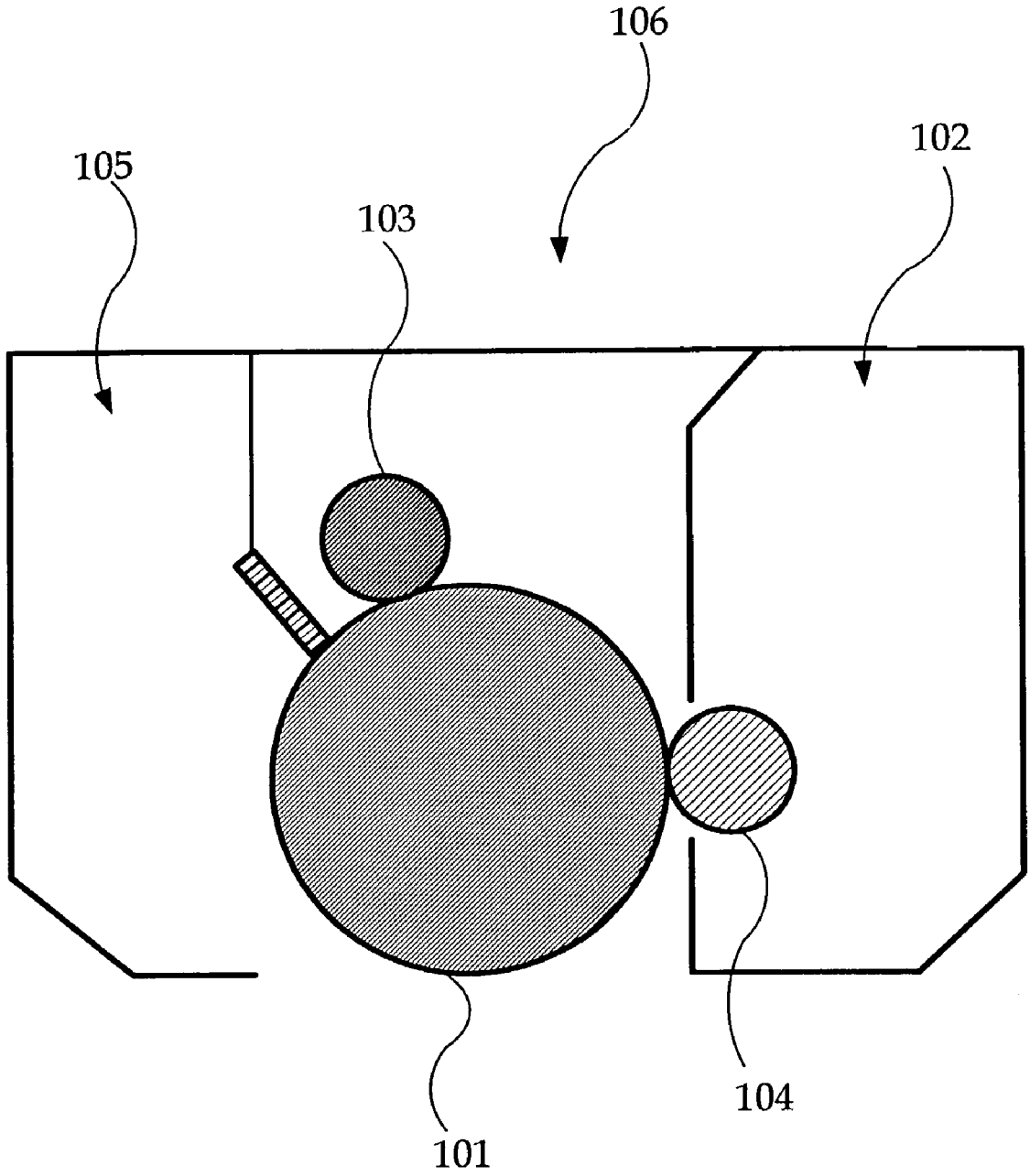
FIG. 7 is a schematic diagram showing an example of the image-forming process cartridge of the present invention.

FIG. 7 is a schematic diagram showing an example of the image forming process unit (process cartridge). The image forming process unit 106 includes a photoconductor drum 101 serving as the latent electrostatic image support, a charge roller 103 serving as the charging device, a cleaning device 105 serving as the cleaning device, and a image developer 102 serving as the image developer. These components of the image forming process unit 106 constitute an integral structure that is attachable to and detachable from a printer main body. The image developer 102 includes a development sleeve 104.

EXAMPLES

The present invention will be described in further detail with reference to several examples and comparative examples below, which are not intended to limit the scope of the present invention. All of "part(s)" and "%" each refer to "part(s) by weight" and "% by weight" unless specified.

[Evaluation]

Test machines, processes, and criteria used in the evaluation of the properties of samples are as follows.

(Test Machines)

One of the following Test Machines A, B, C, D, and E was used to evaluate the properties or qualities of images under test.

(Test Machine A)

Test Machine A was a modified and tuned tandem full-color laser printer IPSiO Color 8000 available from Ricoh Company, Ltd. including a four-color non-magnetic double-component developing unit and four-color photoconductors, in which an original image-fixing unit was replaced with an oilless image-fixing unit. Full-color images were printed at a varying printing speed of 20 to 50 A4-sized sheets per minute in a high-speed printing mode. Herein, "A4-sized sheet" refers to a sheet sized 210 mm width×297 mm length.

(Test Machine B)

Test Machine B was a modified and tuned tandem full-color laser printer IPSiO Color 8000 available from Ricoh Company, Ltd., including a four-color non-magnetic double-component developing unit and four-color photoconductors, in which the system was changed to an intermediate transfer system, and an original image-fixing unit was replaced with an oilless image-fixing unit. In the intermediate transfer system, a toner image was primarily transferred to an intermediate transfer, and the resulting toner image was secondarily transferred to a transfer sheet. Full-color images were printed at a varying printing speed of 20 to 50 A4-sized sheets per minute in a high-speed printing mode.

(Test Machine C)

Test Machine C was a modified and tuned full-color laser copier IMAGIO Color 2800 available from Ricoh Company, Ltd., in which an original image-fixing unit was replaced with an oilless image-fixing unit. This machine was of a system in which four color developing units develop four color images on one drum-shaped photoconductor using double-component developers, the four color images are sequentially transferred onto an intermediate transfer and are then transferred at once to a transfer material. Full-color images were printed at a printing speed of 6 of A4-sized sheets per minute.

(Test Machine D)

Test Machine D was a modified and tuned full-color laser printer IPSiO Color 5000 available from Ricoh Company, Ltd., in which an original image-fixing unit was replaced with an oilless image-fixing unit. This machine was of a system in which four color developing units sequentially develop four color images on one belt-shaped photoconductor using non-magnetic single-component developers, the four color images are sequentially transferred onto an intermediate transfer and are then transferred at once to a transfer material. Full-color images were printed at a printing speed of 6 of A4-sized sheets per minute.

(Test Machine E)

Test Machine E was a tuned tandem full-color laser printer IPSiO Color 8000 available from Ricoh Company, Ltd., including a four-color non-magnetic double-component developing unit and four-color photoconductors, in which an original oil-coated image-fixing unit was used as it is. Full-color images were printed at a varying printing speed of 20 to 50 A4-sized sheets per minute in a high-speed printing mode.

(Evaluation Properties)

1) Scattering of Toner Particles at High Temperature and in High Humidity

A tested toner was stored at high temperature of 35° C. and a high humidity of 80% for 12 hours. A test machine was placed under the same conditions, and 30000 copies of an image chart in a monochrome mode with an image area of 80% were outputted as running output. Thereafter, the developing unit was opened and the amount of toner particles scattered from the development part was visually evaluated and was rated as X, Δ, ○, and ◎ in this order with a decreasing amount of scattered toner particles.

2) Toner Deposition on the Background of Images at Low Temperature and Low Humidity After outputting 30000 copies of an image chart in a monochrome mode with an image area of 7% as running output, a test machine was stopped in the course of development of a blank image. A developer on the photoconductor after development was transferred onto a tape. The difference in image density between the transferred tape and an untransferred tape was evaluated using a Model 938 spectrodensitometer available from X-Rite, Inc. The toner deposition on the background of images was rated as X, Δ, ○, and ◎ in this order with a decreasing difference in image density.

3) Image Density (Colorability)

A total of 200000 copies of an image chart in a monochrome mode with an image area of 50% were outputted as running output, and a solid image was outputted on a 6000 Paper available from Ricoh Company, Ltd. The image density of the solid image was measured, using X-RITE spectrodensitometer available from X-Rite, Inc. This procedure was performed on four colors, respectively, and an average density of four colors was measured. The image density (colorability) was evaluated according to the following criteria.

X: The average image density was less than 1.2.

Δ: The average image density was 1.2 or more and less than 1.4.

○: The average image density was 1.4 or more and less than 1.8.

◎: The average image density was 1.8 or more and less than 2.2.

4) Transparency

A total of 100000 copies of an image chart in a monochrome mode with an image area of 50% were outputted as running output, and images of each color were fixed on an OHP sheet Type DX available from Ricoh Company, Ltd., at an image density of 1.0 mg/cm$^2$ and at an image-fixing temperature of 140° C. The haze of the fixed image was measured using a Digital Haze Computer Model HGM-2DP available from Suga Test Instruments Co., Ltd., and the transparency was rated as X, Δ, ○, and ◎ in this order with a decreasing haze.

5) Chromaticness

After outputting 100000 copies of an image chart in a monochrome mode with an image area of 50% as running output, an image was outputted on a 6000 Paper available from Ricoh Company, Ltd. The chromaticness of the image was visually observed and was rated as X, Δ, ○, and ◎ in this order with an increasing visually observed chromaticness.

6) Color Reproducibility

After outputting 100000 copies of an image chart in a monochrome mode with an image area of 50% as running output, an image was outputted on a 6000 Paper available from Ricoh Company, Ltd. The color reproducibility of the image was visually observed and was rated as X, Δ, ○, and ◎ in this order with an increasing visually observed color reproducibility.

7) Glossiness

After outputting 100000 copies of an image chart in a monochrome mode with an image area of 50% as running output, an image was outputted on a 6000 Paper available from Ricoh Company, Ltd. The glossiness of the image was measured using a gloss meter VG-1D available from Nippon Denshoku Industries, Co., Ltd. at a transmittance angle of 60 degrees and an acceptance angle of 60 degrees with a S mode in a S-S/10 switch after zero point adjustment and calibration using a standard plate. The glossiness was rated according to the following criteria.

◎: The glossiness was 13 or more.

○: The glossiness was 5 or more and less than 13.

Δ: The glossiness was 2 or more and less than 5.

X: The glossiness was less than 2.

8) Light Fastness

After outputting 100000 copies of an image chart in a monochrome mode with an image area of 50% as running output, an image was outputted on a 6000 Paper available from Ricoh Company, Ltd. The image was irradiated with radiation at 10000 lux for 15 hours using a XENON-TESTER XW-150 available from Shimadzu Corporation, and the image after irradiation was then visually observed and was compared with that before irradiation, and the light fastness of the image was rated according to the following criteria.

◎: The image was substantially not changed.

○: The image was slightly changed.

Δ: The image was changed a little.

X: The image was considerably changed.

9) Thin Line Reproducibility

After outputting 30000 copies of an image chart in a monochrome mode with an image area of 50% as running output, an image of a thin line of 600 dpi was outputted on a Type 6000 Paper available from Ricoh Company, Ltd. The bleeding of the thin line was evaluated by a comparison with stepwise quality grade samples and was rated as X, Δ, ○, and ◎ in this order with a decreasing bleeding. This procedure was repeated on four colors.

10) High-temperature Storage Stability

A total of 10 g of each color toner was weighed and was placed in a 20-ml glass vessel, the glass vessel was then tapped hundred times and was left to stand in a thermostat at 55° C. for 24 hours. The depth of penetration of the sample toner was measured using a penetrometer, and the high-temperature storage stability of the toner was rated according to the following criteria.

◎: The depth of penetration was 20 mm or more.

○: The depth of penetration was 15 mm or more and less than 20 mm.

Δ: The depth of penetration was 10 mm or more and less than 15 mm.

X: The depth of penetration was less than 10 mm.

11) Charging Stability at High Temperature and in High Humidity

While outputting 100000 copies of an image chart in a monochrome mode with an image area of 7% at a temperature of 40° C. and a humidity of 90%, a part of a tested developer was sampled for every 1000 copies. The amount of charges of the sampled developer was measured according to a blow-off method, and the charging stability was rated as ◎, ○, Δ, and X in this order with an increasing variation and a decreasing stability in the charge amount.

12) Charging Stability at Low Temperature and Low Humidity

While outputting 100000 copies of an image chart in a monochrome mode with an image area of 7% at a temperature of 10° C. and a humidity of 15%, a part of a tested developer was sampled for every 1000 copies. The amount of charges of the sampled developer was measured according to a blow-off method, and the charging stability was rated as ◎, ○, Δ, and X in this order with an increasing variation and a decreasing stability in the charge amount.

13) Image-fixing Properties

Overall image-fixing properties of a tested toner were evaluated as ⊙, ○, Δ, and X in this order with decreasing image-fixing properties. A toner with excellent image-fixing properties has an image-fixing temperature with sufficient margin of its lower limit and upper limit within acceptable image-fixing temperature, does not invite hot offset and cold offset and is resistant to transportation problems such as wraparound and paper jamming.

(Evaluation on Double-component Developers)

A double-component developer to be tested was prepared by uniformly mixing 5 parts by weight of an each color toner with 100 parts by weight of a carrier in a tumbler mixer, in which its housing was tumbled to mix the contents, and charging the resulting mixture. The carrier used herein was a ferrite carrier having an average particle diameter of 50 μm and being coated with a silicone resin having an average thickness of 0.3 μm prepared in the following manner.

| Preparation of Carrier | | |
|---|---|---|
| Core Material | Cu—Zn ferrite particles (weight-average particle diameter: 35 μm) | 5000 parts |
| Coating Materials | Toluene | 450 parts |
| | Silicone resin SR 2400 (available from Dow Corning Toray Silicone Co., Ltd.; nonvolatile content: 50%) | 450 parts |
| | Aminosilane SH 6020 (available from Dow Corning Toray Silicone Co., Ltd.) | 10 parts |
| | Carbon black | 10 parts |

The coating materials were mixed and dispersed for 10 minutes using a stirrer and thereby yielded a coating composition. The coating composition and the core material were placed in a coating device, to thereby coat the core material with the coating composition. The apparatus had a rotary base plate disk and an impeller in a fluidized bed and served to coat while forming a revolving current. The coated article was then fired in an electric oven at 250° C. for 2 hours and thereby manufactured the carrier.

Example 1

(Polyol Resin 1)

In a separable flask with a stirrer, a thermometer, a nitrogen gas inlet, and a cooling tube (condenser tube), 378.4 g of a low-molecular-weight bisphenol A epoxy resin (number-average molecular weight: about 360), 86.0 g of a high-molecular-weight bisphenol A epoxy resin (number-average molecular weight: about 2700), 191.0 g of a glycidylated adduct of bisphenol A propylene oxide of Formula (1) where "n+m" is about 2.1, 274.5 g of bisphenol F, 70.1 g of p-cumylphenol, and 200 g of xylene were placed. The resulting mixture was heated to 70° C. to 100° C. in an atmosphere of nitrogen gas, was further treated with 0.183 g of lithium chloride and was further heated to 160° C. Water was then added to the mixture under reduced pressure and was bubbled together with xylene to thereby remove water, xylene, other volatile components, and polar-solvent-soluble matters. The residue was allowed to react at 180° C. for 6 to 9 hours and thereby yield a polyol resin (Polyol Resin 1) having Mn of 3800, a molecular weight distribution Mw/Mn of 3.9, Mp of 5000, a softening point of 109° C., Tg of 58° C., and a weight per epoxy equivalent of 20000 or more. In the polymerization reaction, reaction conditions were controlled so that monomer components did not remain. A polyoxyalkylene moiety in a main chain was identified by NMR.

| Preparation of Toners<br>Magenta Toner | |
|---|---|
| Water | 600 parts |
| Pigment Red 122 | 1200 parts |
| Polyol Resin 1 | 1200 parts |

The above raw materials were mixed in a HENSCHEL MIXER and thereby yielded a mixture in which pigment aggregates were impregnated with water. The mixture was kneaded in a two-roll mill at a roll surface temperature of 128° C. for 45 minutes, was rolled and cooled, was pulverized by a pulverizer and thereby yielded a master batch coloring agent (Master Batch).

| | |
|---|---|
| Polyol Resin 1 | 100 parts |
| Master Batch | 14 parts |
| Charge Control Agent (BONTRON E-84 available from Orient Chemical Industries, Ltd.) | 2 parts |
| Wax (a fatty acid ester wax, melting point: 83° C., viscosity: 280 mPa · s (90° C.)) | 5 parts |

The above materials were mixed in a mixer, were then melted and kneaded in a two-roll mill five times, and the kneaded article was rolled and cooled. The resulting article was pulverized in a pulverizer (I-Type Mill, available from Nippon Pneumatic MFG. Co., Ltd.) of collision type, was subjected to air classification by action of a revolving current using a DS classifier (available from Nippon Pneumatic MFG. Co., Ltd.) and thereby yielded magenta colored particles having a volume-average particle diameter of 5.5 μm and a number-average particle diameter of 4.5 μm. The magenta colored particles were further mixed with 1.0% by weight of a hydrophobic silica (HDK H 2000 available from Clariant Japan K.K.) having a primary particle diameter of 10 nm and 0.9% by weight of titanium oxide (MT-150A available from TAYCA CORPORATION) having a primary particle diameter of 15 nm in a HENSCHEL MIXER, the resulting mixture was allowed to pass through a sieve with an aperture of 50 μm to remove aggregates and thereby yielded a magenta toner. The wax was dispersed in the toner in a diameter of 0.2 μm. The toner had a coverage with the coloring agent on its surface of 14.1% by atom, contained 6% by weight of the coloring agent and had 0.67% by atom of nitrogen atoms on its surface. The properties of the toner were evaluated using Test Machine A.

Example 2

A toner was prepared and properties thereof were evaluated by the procedure of Example 1, except that the toner was prepared in the following manner.

| Cyan Toner | |
|---|---|
| Water | 600 parts |
| Pigment Blue 15:3 | 1200 parts |
| Polyol Resin 1 | 1200 parts |

The above raw materials were mixed in a HENSCHEL MIXER and thereby yielded a mixture in which pigment aggregates were impregnated with water. The mixture was kneaded in a two-roll mill at a roll surface temperature of 128° C. for 45 minutes, was rolled and cooled, was pulverized by a pulverizer and thereby yielded a master batch coloring agent (Master Batch).

| | |
|---|---|
| Polyol Resin 1 | 100 parts |
| Master Batch | 7 parts |
| Charge Control Agent (BONTRON E-84 available from Orient Chemical Industries, Ltd.) | 2 parts |
| Wax (a fatty acid ester wax, melting point: 83° C., viscosity: 280 mPa · s (90° C.)) | 5 parts |

The above materials were mixed in a mixer, were then melted and kneaded in a two-roll mill five times, and the kneaded article was rolled and cooled. The resulting article was pulverized in a pulverizer (I-Type Mill, available from Nippon Pneumatic MFG. Co., Ltd.) of collision type, was subjected to air classification by action of a revolving current using a DS classifier (available form Nippon Pneumatic MFG. Co., Ltd.) and thereby yielded cyan colored particles having a volume-average particle diameter of 5.5 μm and a number-average particle diameter of 4.5 μm. The cyan colored particles were further mixed with 1.0% by weight of a hydrophobic silica (HDK H 2000 available from Clariant Japan K.K.) having a primary particle diameter of 10 nm and 0.9% by weight of titanium oxide (MT-150A available from TAYCA CORPORATION) having a primary particle diameter of 15 nm in a HENSCHEL MIXER, the resulting mixture was allowed to pass through a sieve with an aperture of 50 μm to remove aggregates and thereby yielded a cyan toner. The wax was dispersed in the toner in a diameter of 0.2 μm. The toner had a coverage with the coloring agent on its surface of 4.7% by atom, contained 3% by weight of the coloring agent and had 0.66% by atom of nitrogen atoms on its surface.

Example 3

A toner was prepared and properties thereof were evaluated by the procedure of Example 1, except that the toner was prepared in the following manner.

| Yellow Toner | |
|---|---|
| Water | 600 parts |
| Pigment Yellow 180 | 1200 parts |
| Polyol Resin 1 | 1200 parts |

The above raw materials were mixed in a HENSCHEL MIXER and thereby yielded a mixture in which pigment aggregates were impregnated with water. The mixture was kneaded in a two-roll mill at a roll surface temperature of 128° C. for 45 minutes, was rolled and cooled, was pulverized by a pulverizer and thereby yielded a master batch coloring agent (Master Batch).

| | |
|---|---|
| Polyol Resin 1 | 100 parts |
| Master Batch | 12 parts |

-continued

| | |
|---|---|
| Charge Control Agent (BONTRON E-84 available from Orient Chemical Industries, Ltd.) | 2 parts |
| Wax (a fatty acid ester wax, melting point: 83° C., viscosity: 280 mPa · s (90° C.)) | 5 parts |

The above materials were mixed in a mixer, were then melted and kneaded in a two-roll mill five times, and the kneaded article was rolled and cooled. The resulting article was pulverized in a pulverizer (I-Type Mill, available from Nippon Pneumatic MFG. Co., Ltd.) of a collision type, was subjected to air classification by action of a revolving current using a DS classifier (available form Nippon Pneumatic MFG. Co., Ltd.) and thereby yielded yellow colored particles having a volume-average particle diameter of 5.5 μm and a number-average particle diameter of 4.5 μm. The yellow colored particles were further mixed with 1.0% by weight of a hydrophobic silica (HDK H 2000 available from Clariant Japan K.K.) having a primary particle diameter of 10 nm and 0.9% by weight of titanium oxide (MT-150A available from TAYCA CORPORATION) having a primary particle diameter of 15 nm in a HENSCHEL MIXER, the resulting mixture was allowed to pass through a sieve with an aperture of 50 μm to remove aggregates and thereby yielded a yellow toner. The wax was dispersed in the toner in a diameter of 0.3 μm. The toner had a coverage with the coloring agent on its surface of 6.5% by atom, contained 5% by weight of the coloring agent and had 0.89% by atom of nitrogen atoms on its surface.

Example 4

A toner was prepared and properties thereof were evaluated by the procedure of Example 1, except that the toner was prepared in the following manner.

| Magenta Toner | |
|---|---|
| Water | 600 parts |
| Pigment Red 57:1 | 1200 parts |
| Polyol Resin 1 | 1200 parts |

The above raw materials were mixed in a HENSCHEL MIXER and thereby yielded a mixture in which pigment aggregates were impregnated with water. The mixture was kneaded in a two-roll mill at a roll surface temperature of 128° C. for 45 minutes, was rolled and cooled, was pulverized by a pulverizer and thereby yielded a master batch coloring agent (Master Batch).

| | |
|---|---|
| Polyol Resin 1 | 100 parts |
| Master Batch | 8 parts |
| Charge Control Agent (BONTRON E-84 available from Orient Chemical Industries, Ltd.) | 2 parts |
| Wax (a fatty acid ester wax, melting point: 83° C., viscosity: 280 mPa · s (90° C.)) | 5 parts |

The above materials were mixed in a mixer, were then melted and kneaded in a two-roll mill five times, and the kneaded article was rolled and cooled. The resulting article was pulverized in a pulverizer (I-Type Mill, available from Nippon Pneumatic MFG. Co., Ltd.) of a collision type, was subjected to air classification by action of a revolving current using a DS classifier (available form Nippon Pneumatic MFG. Co., Ltd.) and thereby yielded magenta colored particles having a volume-average particle diameter of 5.5 μm and a number-average particle diameter of 4.5 μm. The magenta colored particles were further mixed with 1.0% by weight of a hydrophobic silica (HDK H 2000 available from Clariant Japan K.K.) having a primary particle diameter of 10 nm and 0.9% by weight of titanium oxide (MT-150A available from TAYCA CORPORATION) having a primary particle diameter of 15 nm in a HENSCHEL MIXER, the resulting mixture was allowed to pass through a sieve with an aperture of 50 μm to remove aggregates and thereby yielded a magenta toner. The wax was dispersed in the toner in a diameter of 0.2 μm. The toner had a coverage with the coloring agent on its surface of 1.6% by atom, contained 3% by weight of the coloring agent and had 0.11% by atom of nitrogen atoms on its surface.

Example 5

A toner was prepared and properties thereof were evaluated by the procedure of Example 1, except that the toner was prepared in the following manner.

| Magenta Toner | |
|---|---|
| Water | 600 parts |
| Pigment Red 185 | 1200 parts |
| Polyol Resin 1 | 1200 parts |

The above raw materials were mixed in a HENSCHEL MIXER and thereby yielded a mixture in which pigment aggregates were impregnated with water. The mixture was kneaded in a two-roll mill at a roll surface temperature of 126° C. for 45 minutes, was rolled and cooled, and was pulverized by a pulverizer. The article was then further kneaded in a two-roll mill at a roll surface temperature of 125° C. for 40 minutes, was rolled and cooled, was pulverized by a pulverizer and thereby yielded a master batch coloring agent (Master Batch).

| | |
|---|---|
| Polyol Resin 1 | 100 parts |
| Master Batch | 8 parts |
| Charge Control Agent (BONTRON E-84 available from Orient Chemical Industries, Ltd.) | 2 parts |
| Wax (a fatty acid ester wax, melting point: 83° C., viscosity: 280 mPa · s (90° C.)) | 5 parts |

The above materials were mixed in a mixer, were then melted and kneaded in a two-roll mill five times, and the kneaded article was rolled and cooled. The resulting article was pulverized in a pulverizer (I-Type Mill, available from Nippon Pneumatic MFG. Co., Ltd.) of a collision type, was subjected to air classification by action of a revolving current using a DS classifier (available form Nippon Pneumatic MFG. Co., Ltd.) and thereby yielded magenta colored particles having a volume-average particle diameter of 5.5 μm and a number-average particle diameter of 4.5 μm. The magenta colored particles were further mixed with 1.0% by weight of a hydrophobic silica (HDK H 2000 available from Clariant Japan K.K.) having a primary particle diameter of 10 nm and 0.9% by weight of titanium oxide (MT-150A available from TAYCA CORPORATION) having a primary particle diameter of 15 nm in a HENSCHEL MIXER, the resulting mixture was allowed to pass through a sieve with an aperture of 50 μm to remove aggregates and thereby yielded a magenta toner. The wax was dispersed in the toner in a diameter of 0.2 μm. The toner had a coverage with the coloring agent on its surface of 8.0% by atom, contained 3% by weight of the coloring agent and had 0.46% by atom of nitrogen atoms on its surface.

Example 6

A toner was prepared and properties thereof were evaluated by the procedure of Example 1, except that the toner was prepared in the following manner.

| Magenta Toner | |
|---|---|
| Water | 600 parts |
| Pigment Red 57:1 | 1200 parts |
| Polyol Resin 1 | 1200 parts |

The above raw materials were mixed in a HENSCHEL MIXER and thereby yielded a mixture in which pigment aggregates were impregnated with water. The mixture was kneaded in a two-roll mill at a roll surface temperature of 128° C. for 45 minutes, was rolled and cooled, was pulverized by a pulverizer and thereby yielded a master batch coloring agent (Master Batch).

| | |
|---|---|
| Polyol Resin 1 | 100 parts |
| Master Batch | 30 parts |
| Charge Control Agent (BONTRON E-84 available from Orient Chemical Industries, Ltd.) | 2 parts |
| Wax (a fatty acid ester wax, melting point: 83° C., viscosity: 280 mPa · s (90° C.)) | 5 parts |

The above materials were mixed in a mixer, were then melted and kneaded in a two-roll mill five times, and the kneaded article was rolled and cooled. The resulting article was pulverized in a pulverizer (I-Type Mill, available from Nippon Pneumatic MFG. Co., Ltd.) of a collision type, was subjected to air classification by action of a revolving current using a DS classifier (available form Nippon Pneumatic MFG. Co., Ltd.) and thereby yielded magenta colored particles having a volume-average particle diameter of 5.5 μm and a number-average particle diameter of 4.5 μm. The magenta colored particles were further mixed with 1.0% by weight of a hydrophobic silica (HDK H 2000 available from Clariant Japan K.K.) having a primary particle diameter of 10 nm and 0.9% by weight of titanium oxide (MT-150A available from TAYCA CORPORATION) having a primary particle diameter of 15 nm in a HENSCHEL MIXER, the resulting mixture was allowed to pass through a sieve with an aperture of 50 μm to remove aggregates and thereby yielded a magenta toner. The wax was dispersed in the toner in a diameter of 0.2 μm. The toner had a coverage with the coloring agent on its surface of 15.0% by atom, contained 11% by weight of the coloring agent and had 0.06% by atom of nitrogen atoms on its surface.

Example 7

A full-color toner kit was prepared and properties thereof were evaluated in a full-color mode by the procedure of Example 1. The full-color toner kit contained the magenta toner, the cyan toner, and the yellow toner prepared in Examples 1, 2, and 3 and a black toner prepared in the following manner. The coverage with the coloring agent of the black toner was not measured. In addition, the nitrogen amount thereof was not measured, since the black toner did not contain nitrogen.

| Black Toner | |
|---|---|
| Water | 1000 parts |
| Phthalocyanine Green Wet Cake (solid contents: 30%) | 200 parts |
| Carbon Black (MA 60 available from Mitsubishi Chemical Corporation) | 1000 parts |
| Polyol Resin 1 | 1000 parts |

The above raw materials were mixed in a HENSCHEL MIXER and thereby yielded a mixture in which pigment aggregates were impregnated with water. The mixture was kneaded in a two-roll mill at a roll surface temperature of 128° C. for 45 minutes, was rolled and cooled, was pulverized by a pulverizer and thereby yielded a master batch coloring agent (Master Batch).

| | |
|---|---|
| Polyol Resin 1 | 100 parts |
| Master Batch | 10 parts |
| Charge Control Agent (BONTRON E-84 available from Orient Chemical Industries, Ltd.) | 2 parts |
| Wax (a fatty acid ester wax, melting point: 83° C., viscosity: 280 mPa · s (90° C.)) | 5 parts |

The above materials were mixed in a mixer, were then melted and kneaded in a two-roll mill three times or more, and the kneaded article was rolled and cooled. The resulting article was pulverized in a pulverizer (I-Type Mill, available from Nippon Pneumatic MFG. Co., Ltd.) of a collision type, was subjected to air classification by action of a revolving current using a DS classifier (available form Nippon Pneumatic MFG. Co., Ltd.) and thereby yielded black colored particles having a volume-average particle diameter of 5.5 μm and a number-average particle diameter of 4.5 μm. The black colored particles were further mixed with 1.0% by weight of a hydrophobic silica (HDK H 2000 available from Clariant Japan K.K.) having a primary particle diameter of 10 nm and 0.9% by weight of titanium oxide (MT-150A available from TAYCA CORPORATION) having a primary particle diameter of 15 nm in a HENSCHEL MIXER, the resulting mixture was allowed to pass through a sieve with an aperture of 50 μm to remove aggregates and thereby yielded a black toner. The wax was dispersed in the toner in a diameter of 0.2 μm. The toner contained 4% by weight of the coloring agent.

Example 8

A toner was prepared and properties thereof were evaluated by the procedure of Example 1, except that the resin was changed to a polyester resin prepared from fumaric acid, polyoxypropylene-(2.2)-2,2-bis(4-hydroxyphenyl)propane, polyoxyethylene-(2.3)-2,2-bis(4-hydroxyphenyl)propane, and trimellitic anhydride. The polyester resin had an acid value of 10, a hydroxyl value of 30, Mn of 5000, Mw/Mn of 10, Mp of 9000, Tg of 61° C., and a softening point of 108° C. The resulting toner had a volume-average particle diameter of 5.5 μm, a number-average particle diameter of 4.5 μm, and a coverage with the coloring agent on its surface of 12.8% by atom. The toner contained 6% by weight of the coloring agent and had 0.72% by atom of nitrogen atoms on its surface.

Example 9

A toner and a developer were prepared and properties thereof were evaluated by the procedure of Example 1, except that the resulting toner was classified so as to have a volume-average particle diameter of 6.5 μ,m and a number-average particle diameter of 5.4 μm. The toner had a coverage with the coloring agent on its surface of 13.8% by atom, contained 6% by weight of the coloring agent and had 0.65% by atom of nitrogen atoms on its surface.

Example 10

A toner and a developer were prepared and properties thereof were evaluated by the procedure of Example 1, except that the resulting toner was classified so as to have a volume-average particle diameter of 4.5 μm and a number-average particle diameter of 3.6 μm. The toner had a coverage with the coloring agent on its surface of 14.3% by atom, contained 6% by weight of the coloring agent and had 0.85% by atom of nitrogen on its surface.

Example 11

A toner and a developer were prepared and properties thereof were evaluated by the procedure of Example 1, except that the resulting toner was classified so as to have a volume-average particle diameter of 2 μm and a number-average particle diameter of 1.4 μm. The toner had a coverage with the coloring agent on its surface of 14.9% by atom, contained 6% by weight of the coloring agent and had 1.23% by atom of nitrogen on its surface.

Example 12

A toner and a developer were prepared and properties thereof were evaluated by the procedure of Example 1, except that the toner had a spherical shape by pulverizing in a Turbo Mill (available from Turbo Kogyo Co., Ltd.). The toner had a circularity in SF-1 of 140, a circularity in SF-2 of 130, and a coverage with the coloring agent on its surface of 13.5% by atom. The toner contained 6% by weight of the coloring agent and had 0.75% by atom of nitrogen atoms on its surface.

Example 13

A toner was prepared and properties thereof were evaluated by the procedure of Example 1, except that the toner was prepared according to the following emulsion polymerization.

| Preparation of Resin Dispersion 1 | |
|---|---|
| Styrene | 350 parts |
| Butyl acrylate | 41 parts |
| Acrylic acid | 9 parts |
| Dodecyl mercaptan | 16 parts |
| Carbon tetrabromide | 5 parts |

The above raw materials (all available from Wako Pure Chemical Industries, Ltd.) were mixed, and the resulting mixture was dispersed and emulsified in a solution containing 9 parts of a nonionic surfactant (Nonipol 85 available from Sanyo Chemical Industries, Ltd.) and 11 parts of an anionic surfactant (Neogen SC available from Dai-ichi Kogyo Seiyaku Co., Ltd.) in 582 parts of ion-exchanged water in a flask. The resulting emulsion (dispersion) was further treated with a solution of 3.4 g of ammonium persulfate (available from Tokai Denka Kogyo Kabushiki Kaisha) in 50 g of ion-exchanged water while gently stirring for 15 minutes, and an inside atmosphere was replaced with nitrogen gas. The resulting mixture was then heated to 73° C. on an oil bath with stirring, was held at the temperature to perform an emulsion polymerization for 7 hours, was cooled to room temperature and thereby yielded a resin dispersion. The resin dispersion was then left to stand in an oven at 80° C. to remove water and thereby yielded a resin dispersion (Resin Dispersion 1) of a resin having an average particle diameter of 120 nm, a glass transition temperature, Tg, of 55° C., and Mw of 22000.

70 parts of a Pigment Red 122 and 2 parts of an anionic surfactant (Ionet D-2 available from Sanyo Chemical Industries, Ltd.) were added to 300 parts of ion-exchanged water, and the resulting mixture was dispersed using a homogenizer (ULTRA-TURRAX T50 available from IKA) and thereby yielded a pigment dispersion (Pigment Dispersion 1) having an average particle diameter of 160 nm.

50 parts of wax (a fatty acid ester wax, melting point: 83° C., viscosity: 280 mPa·s (90° C.)) and 2 parts of an anionic surfactant (Ionet D-2 available from Sanyo Chemical Industries, Ltd.) were added to 300 parts of ion-exchanged water, and the resulting mixture was dispersed using a homogenizer (ULTRA-TURRAX T50 available from IKA) and thereby yielded wax dispersion (Wax Dispersion 1).

| | |
|---|---|
| Ion-exchanged water | 300 parts |
| Resin Dispersion 1 | 240 parts |
| Pigment Dispersion 1 | 40 parts |
| Wax Dispersion 1 | 35 parts |
| Cationic Surfactant (Sanisol B-50 available from Kao Corporation) | 2 parts |

The above materials were mixed and dispersed in a round stainless steel flask using an ULTRA-TURRAX T50, the resulting mixture in the flask was heated to 48° C. on a heating oil bath with stirring. After holding at 48° C. for 4 hours, the mixture was observed with an optical microscope to find that aggregate particles of about 5.5 μm were formed. The mixture was further treated with 6 parts of an anionic surfactant (Neogen SC available from Dai-ichi Kogyo Seiyaku Co., Ltd.), was heated to 93° C. and was held at this temperature for 9 hours with stirring. The mixture was cooled to room temperature at a cooling rate of 10° C. per minute, was further filtrated, was sufficiently washed with ion-exchanged water, was left to stand in a vacuum oven at 50° C. for 12 hours and thereby yielded magenta colored particles having a volume-average particle diameter of 5.5 μm, a number-average particle diameter of 4.7 μm, and a weight-average molecular weight Mw of 22000. The magenta colored particles were further mixed with 1.0% by weight of a hydrophobic silica (HDK H 2000 available from Clariant Japan K.K.) having a primary particle diameter of 10 nm and 0.9% by weight of titanium oxide (MT-150A available from TAYCA CORPORATION) having a primary particle diameter of 15 nm in a HENSCHEL MIXER, the resulting mixture was allowed to pass through a sieve with an aperture of 50 μm to remove aggregates and thereby yielded a magenta toner. The toner had a circularity in SF-1 of 108, a circularity in SF-2 of 105, a coverage with the coloring agent on its surface of 14.8% by atom, contained 8% by weight of the coloring agent and had 1.21% by atom of nitrogen atoms on its surface.

Example 14

A toner was prepared and properties thereof were evaluated by the procedure of Example 1, except that Test Machine B was used as the test machine.

Example 15

A toner was prepared and properties thereof were evaluated by the procedure of Example 1, except that Test Machine C was used as the test machine.

Example 16

A toner was prepared and properties thereof were evaluated by the procedure of Example 1, except that Test Machine D was used as the test machine.

Example 17

A toner was prepared and properties thereof were evaluated by the procedure of Example 1, except that no wax was added in the preparation of the toner and that Test Machine E was used as the test machine. The resulting toner had a volume-average particle diameter of 5.5 μm, a number-average particle diameter of 4.6 μm, a coverage with the coloring agent on its surface of 12.8% by atom, contained 6% by weight of the coloring agent and had 0.57% by atom of nitrogen atoms on its surface.

Comparative Example 1

A toner and a developer were prepared and properties thereof were evaluated by the procedure of Example 1, except that the master batch coloring agent was prepared by kneading in a two-roll mill at a roll surface temperature of 115° C. for 40 minutes. The resulting toner contained 6% by weight of the coloring agent and had 1.42% by atom of nitrogen atoms on its surface.

Comparative Example 2

A toner was prepared and properties thereof were evaluated by the procedure of Example 4, except that the toner was prepared by kneading the materials in a co-kneader (available from Buss Co., Ltd.), cooling and rolling the kneaded article, roughly pulverizing and kneading again in a co-kneader. The resulting toner had a coverage with the coloring agent on its surface of 1.3% by atom, contained 3% by weight of the coloring agent and had 0.04% by atom of nitrogen atoms on its surface.

Comparative Example 3

A toner was prepared and properties thereof were evaluated by the procedure of Example 1, except that the proportions of the master batch coloring agent and the binder resin were changed so that the toner contained 1.3% by weight of the coloring agent. The resulting toner had a coverage with the coloring agent on its surface of 1.8% by atom and had 0.08% by atom of nitrogen atoms on its surface.

Comparative Example 4

A toner was prepared and properties thereof were evaluated by the procedure of Example 4, except that the proportions of the master batch coloring agent and the binder resin were changed so that the toner contained 16% by weight of the coloring agent. The resulting toner had a coverage with the coloring agent on its surface of 14.2% by atom and had 0.96% by atom of nitrogen atoms on its surface.

TABLE 1

| | Test Machine | Toner scattering | Toner deposition on background | Image density | Trans-parency | Chroma-ticness | Color reproduci-bility | Glossiness |
|---|---|---|---|---|---|---|---|---|
| Ex. 1 | A | ○ | ○ | ○ | ○ | ○ | ◎ | ◎ |
| Ex. 2 | A | ◎ | ○ | ○ | ○ | ○ | ◎ | ◎ |
| Ex. 3 | A | ○ | ◎ | ○ | ○ | ◎ | ◎ | ◎ |
| Ex. 4 | A | ◎ | ◎ | ○ | ○ | Δ | ○ | ○ |
| Ex. 5 | A | ○ | ○ | ◎ | Δ | Δ | ○ | ◎ |
| Ex. 6 | A | ○ | Δ | ◎ | Δ | ○ | ◎ | ◎ |
| Ex. 7 | A | ○ | ○ | ○ | ○ | ○ | ○ | ◎ |
| Ex. 8 | A | ○ | Δ | ○ | ◎ | ◎ | ◎ | ◎ |
| Ex. 9 | A | ◎ | ○ | ○ | ○ | ○ | ○ | ○ |
| Ex. 10 | A | ○ | Δ | ○ | ◎ | ◎ | ◎ | ◎ |
| Ex. 11 | A | Δ | Δ | ○ | ◎ | ◎ | ◎ | ◎ |
| Ex. 12 | A | ○ | ○ | ○ | ○ | ◎ | ◎ | ◎ |
| Ex. 13 | A | Δ | ○ | ○ | ○ | ◎ | ◎ | ○ |
| Ex. 14 | B | ○ | ○ | ○ | ○ | ◎ | ◎ | ◎ |
| Ex. 15 | C | ◎ | ○ | ○ | ○ | ○ | ◎ | ◎ |
| Ex. 16 | D | Δ | Δ | ○ | ○ | ○ | ◎ | ◎ |
| Ex. 17 | E | ◎ | ◎ | ○ | ○ | ○ | ◎ | ◎ |
| Comp. Ex. 1 | A | X | X | ○ | ○ | ○ | ◎ | ◎ |
| Comp. Ex. 2 | A | ○ | ◎ | X | ○ | ○ | ◎ | ◎ |
| Comp. Ex. 3 | A | ◎ | ○ | X | ◎ | ○ | ◎ | ◎ |
| Comp. Ex. 4 | A | X | X | ◎ | X | ○ | X | X |

| | Light fastness | Thin line reproduci-bility | High-temperature storage stability | Charging properties at high tem-perature and humidity | Charging properties at low tem-perature and humidity | Imaging-fixing properties |
|---|---|---|---|---|---|---|
| Ex. 1 | ○ | ○ | ○ | ○ | ○ | ○ |
| Ex. 2 | ○ | ○ | ○ | ○ | ○ | ○ |
| Ex. 3 | ○ | ○ | ○ | ○ | ◎ | ○ |
| Ex. 4 | Δ | ○ | ◎ | ○ | ○ | ○ |
| Ex. 5 | ○ | ○ | ○ | Δ | ○ | Δ |
| Ex. 6 | Δ | Δ | Δ | Δ | Δ | Δ |
| Ex. 7 | ○ | ○ | ○ | ○ | ○ | ○ |
| Ex. 8 | ○ | ○ | ○ | Δ | Δ | Δ |
| Ex. 9 | ○ | Δ | ◎ | ◎ | ○ | ○ |
| Ex. 10 | ○ | ◎ | ○ | ○ | Δ | Δ |
| Ex. 11 | ○ | ○ | Δ | Δ | Δ | Δ |
| Ex. 12 | ○ | ◎ | ◎ | ○ | ○ | ○ |
| Ex. 13 | ○ | ◎ | ◎ | Δ | Δ | Δ |
| Ex. 14 | ○ | ◎ | ○ | ○ | ○ | ○ |
| Ex. 15 | ○ | ○ | ○ | ○ | ○ | ○ |
| Ex. 16 | ○ | ○ | ○ | ○ | Δ | ○ |
| Ex. 17 | ○ | ○ | ○ | ◎ | ◎ | ○ |
| Comp. Ex. 1 | ○ | ○ | ○ | X | X | ○ |
| Comp. Ex. 2 | X | ○ | X | ○ | ○ | X |
| Comp. Ex. 3 | ○ | X | ○ | ○ | ○ | X |
| Comp. Ex. 4 | ○ | ○ | ○ | Δ | X | ○ |

The present invention can provide a toner, a developer containing the toner, an image-forming process using the developer, a developer-container containing the developer, and an image-forming apparatus using the developer-container, in which the toner exhibits highly stable and satisfactory charging properties, includes less weakly charged particles and inversely charged particles and does not invite scattering of toner particles even after it is stored at high temperature and in high humidity for a long time and is subjected to printing several tens of thousands of sheets at high temperature and in high humidity. The present invention can also provide a toner, a developer containing the toner, an image-forming process using the developer, a developer-container containing the developer, and an image-forming apparatus using the developer-container, in which the toner exhibits satisfactory charging stability, includes less weakly charged particles and inversely charged particles, and does not invite toner deposition on the background of images even after it is subjected to printing several tens of thousands of sheets not only at normal temperature and in normal humidity but also at low temperature and in low humidity. The present invention can further provides a toner, a developer containing the toner, an image-forming process using the developer, a developer-container containing the developer, and an image-forming apparatus using the developer-container, in which the toner exhibits sufficient colorability, light fastness, transparency, color development, sharpness, color reproducibility, color saturation (chromaticness), and glossiness even after the toner is subjected to printing several tens of thousands of sheets.

What is claimed is:

1. A toner, comprising:

a binder resin; and

2% by weight to 15% by weight of a coloring agent;

wherein a coverage with the coloring agent on a surface of the toner is 1.5% by atom to 15% by atom.

2. The toner according to claim 1, wherein the binder resin comprises a polyol resin.

3. The toner according to claim 1, wherein the binder resin comprises a polyol resin which has an epoxy resin moiety and a polyoxyalkylene moiety in a main chain thereof.

4. The toner according to claim 1, wherein the toner has a volume-average particle diameter of 1 μm to 6 μm.

5. The toner according to claim 1, having a circularity of 100 to 140 in SF-1 based on the following Equation (1), and a circularity of 100 to 130 in SF-2 based on the following Equation (2);

$$SF\text{-}1=(L^2/A)\times(\pi/4)\times 100 \quad \text{Equation (1)}$$

$$SF\text{-}2=(P^2/A\times(1/4\pi)\times 100 \quad \text{Equation (2)}$$

wherein in the Equations (1) and (2), L is the absolute maximum length of the toner; A is the projected area of the toner; and P is the maximum perimeter of the toner.

6. The toner according to claim 1, wherein the coloring agent is at least one member selected from the group consisting of black, magenta, yellow, cyan and mixtures thereof.

7. The toner according to claim 1, having 0.05% by atom to 1.3% by atom of a nitrogen atom on a surface of said toner, relative to a total number of atoms on the surface.

8. The toner according to claim 7, wherein the binder resin comprises a polyol resin.

9. The toner according to claim 7, having a volume-average particle diameter of 1 μm to 6 μm.

10. The toner according to claim 7, having a circularity of 100 to 140 in SF-1, and a circularity of 100 to 130 in SF-2.

11. The toner according to claim 7, wherein the coloring agent is at least one member selected from the group consisting of black, magenta, yellow, cyan and mixtures thereof.

12. A developer, comprising:

a toner comprising:

a binder resin; and

2% by weight to 15% by weight of a coloring agent;

wherein a coverage with the coloring agent on a surface of the toner is 1.5% by atom to 15% by atom.

13. The developer according to claim 12, further comprising:

carriers comprising magnetic particles.

14. The developer according to claim 12, which is a single-component developer.

15. A full-color toner kit, comprising:

a magenta toner;

a yellow toner; and a cyan toner;

wherein at least one member selected from the group consisting of the magenta toner, the yellow toner, and the cyan toner is a toner for developing a latent electrostatic image, and the toner comprises:

a binder resin; and

2% by weight to 15% by weight of a coloring agent;

wherein a coverage with the coloring agent on a surface of the toner is 1.5% by atom to 15% by atom.

16. A developer container, comprising:

a developer which comprises a toner comprising:

a binder resin; and

2% by weight to 15% by weight of a coloring agent;

wherein a coverage with the coloring agent on a surface of the toner is 1.5% by atom to 15% by atom.

17. An image-fonning apparatus, comprising:

a latent electrostatic image support;

a charger configured to charge the latent electrostatic image support;

a light-irradiator configured to irradiate a light to the latent electrostatic image support so as to form a latent electrostatic image;

an image developer comprising to have a developer container, to supply a developer to the latent electrostatic image, and to visualize the latent electrostatic image, so as to form a toner image;

and a transfer configured to transfer the toner image onto a transfer material, wherein the developer container comprises a toner comprising:

a binder resin; and

2% by weight to 15% by weight of a coloring agent;

wherein a coverage with the coloring agent on a surface of the toner is 1.5% by atom to 15% by atom.

18. An image-forming process cartridge, comprising:

a developer;

an image developer configured to have a developer container, and to supply the developer to a latent electrostatic image, so as to visualize the latent electrostatic image and form a toner image;

a latent electrostatic image support;

a charger configured to charge a surface of the latent electrostatic image uniformly; and a cleaner configured to clean the surface of the latent electrostatic image support, wherein the image-forming process cartridge is formed in one-piece construction, and is attachable to and detachable from an image-forming apparatus, wherein the developer comprises a toner comprising:

a binder resin; and

2% by weight to 15% by weight of a coloring agent;

wherein a coverage with the coloring agent on a surface of the toner is 1.5% by atom to 15% by atom.

19. An image-forming process, comprising:

charging a latent electrostatic image support;

irradiating a light to the latent electrostatic image support;

supplying a developer so as to visualize a latent electrostatic image and to form a toner image; and transferring the toner image onto a transfer material;

wherein the developer comprises a toner comprising:

a binder resin; and

2% by weight to 15% by weight of a coloring agent;

wherein a coverage with the coloring agent on a surface of the toner is 1.5% by atom to 15% by atom.

20. The image-forming process according to claim 19, wherein a color image is formed by a tandem method at a speed of 20 sheets per minute or faster, when an A4 sized sheet is used.

* * * * *